US007238468B2

(12) United States Patent
Ohshima et al.

(10) Patent No.: US 7,238,468 B2
(45) Date of Patent: Jul. 3, 2007

(54) SILVER HALIDE EMULSION AND SILVER HALIDE COLOR PHOTOGRAPHIC LIGHT-SENSITIVE MATERIAL

(75) Inventors: Naoto Ohshima, Kanagawa (JP); Tadanobu Sato, Kanagawa (JP); Tadashi Inaba, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/798,415

(22) Filed: Mar. 12, 2004

(65) Prior Publication Data

US 2004/0180304 A1 Sep. 16, 2004

(30) Foreign Application Priority Data

Mar. 13, 2003 (JP) ..... P. 2003-068446
Oct. 30, 2003 (JP) ..... P. 2003-370062

(51) Int. Cl.
*G03C 1/06* (2006.01)
*G03C 1/005* (2006.01)
*G03C 1/494* (2006.01)

(52) U.S. Cl. ..... 430/599; 430/604; 430/605; 430/567; 430/569

(58) Field of Classification Search ..... 430/567, 430/569, 599, 605, 604
See application file for complete search history.

(56) References Cited

U.S. PATENT DOCUMENTS

| | | | | |
|---|---|---|---|---|
| 5,360,712 | A | 11/1994 | Olm et al. | |
| 5,474,888 | A | 12/1995 | Bell | |
| 5,480,771 | A | 1/1996 | Bell | |
| 5,783,373 | A | 7/1998 | Mydlarz et al. | |
| 6,638,702 | B2 | 10/2003 | Sato et al. | |
| 6,808,870 | B2 * | 10/2004 | Sato et al. | 430/567 |
| 6,902,879 | B2 * | 6/2005 | Inaba et al. | 430/604 |
| 2002/0142255 | A1 | 10/2002 | Yamashita | |
| 2004/0058285 | A1 * | 3/2004 | Sato et al. | 430/569 |

* cited by examiner

*Primary Examiner*—Geraldina Visconti
(74) *Attorney, Agent, or Firm*—Sughrue Mion, PLLC

(57) ABSTRACT

To provide a silver halide color photographic light-sensitive material having higher sensitivity and higher contrast and free of reciprocity failure over a wide range of exposure illuminance, A silver halide emulsion comprising a silver halide grain containing at least two metal complexes each giving an average electron releasing time of $10^{-5}$ to 3 seconds, the ratio in the average electron releasing time between these two metal complexes being at least 3 times or more and in these metal complexes, the content of the metal complex having a shorter average electron releasing time being 3 times or more as the molar ratio to the content of the metal complex having a longer average electron releasing time.

10 Claims, No Drawings

SILVER HALIDE EMULSION AND SILVER HALIDE COLOR PHOTOGRAPHIC LIGHT-SENSITIVE MATERIAL

BACKGROUND OF THE INVENTION

1. Technical Field

The present invention relates to a silver halide emulsion and a silver halide color photographic light-sensitive material, more specifically, the present invention relates to a silver halide color photographic light-sensitive material using a dopant technique and ensuring high sensitivity, high gradation, no reciprocity failure, stable latent image and excellent aptitude for rapid processing.

2. Background Art

One of techniques of modifying a silver halide grain and thereby improving the performance of the entire silver halide color photographic light-sensitive material as desired is a technique of integrating a substance (dopant) except for a silver ion and a halide ion (doping technique). Particularly, many studies have been made on the technique of doping a transition metal ion. As generally recognized, when a transition metal ion is integrated as a dopant into a silver halide grain, this ion effectively modifies the photographic performance even if the amount of the dopant added is very small.

In order to more effectively improve the photographic properties of a silver halide emulsion, not only a technique of doping a transition metal ion but also a technique of doping a transition metal complex into a silver halide grain are known. The performance of a silver halide emulsion, which is improved by the doping of a transition metal complex into a silver halide grain, includes sensitivity (higher sensitivity), reciprocity failure (low illuminance reciprocity failure, high illuminance reciprocity failure) and gradation (higher contrast). In a high silver chloride emulsion, improvement in the high illuminance reciprocity failure is particularly important. For improving the high illuminance reciprocity failure, an iridium complex is used in many cases. Examples of the silver halide grain doped with an iridium complex are described in JP-A-1-285941, JP-A-3-118583, JP-A-4-213449, JP-A-4-278940, JP-A-5-66511, JP-A-5-313277, JP-A-6-82947, JP-A-6-235995, JP-A-7-72569, JP-A-7-72576, JP-A-11-202440 and JP-A-11-295841. The ligand of the iridium complex is most commonly a chloride ion but other than that, a fluoride ion, a bromide ion, $H_2$, a cyanide ion, a nitrosyl and a thionitrosyl are used. Furthermore, a dopant technique using an organic compound as the ligand is disclosed in U.S. Pat. No. 5,360,712 and $[IrCl_5(thia)]^2$-(thia: thiazole) is disclosed as a dopant of improving the high illuminance reciprocity failure.

On the other hand, for obtaining a high-sensitive emulsion, many examples of an emulsion doped with a Group VIII metal complex having 6 cyanide ions as ligands are disclosed. JP-B-48-35373 (the term "JP-B" as used herein means an "examined Japanese patent publication") discloses hexacyanoferrate(II) complexes and hexacyanoferrate(III) complexes as a dopant containing a cyanide ion. Also, many other examples of obtaining a high-sensitive emulsion by doping a hexacyanoferrate(II) complex are known and disclosed, for example, in JP-A-5-66511 and U.S. Pat. No. 5,132,203. Other than the iron complex, high-sensitive emulsions obtained by doping a cyano complex are known and JP-A-2-20853 discloses that when a complex of rhenium, ruthenium, osmium or iridium is doped into silver iodochloride, a high-sensitive emulsion is obtained. The doping technique is used also for obtaining a high-gradation emulsion and a technique of using a nitrosyl or a thionitrosyl as the ligand of a transition metal complex is disclosed in European Patents 033642, 0606895 and 0610670. At this time, ruthenium or osmium is used as the center metal. A high-contrast emulsion is effectively obtained by not only using a nitrosyl or a thionitrosyl but also using hexachlororuthenium, hexachlororhodium or hexachlororhenium and this is described in JP-A-63-184740, JP-A-1-285941, JP-A-2-20852 and JP-A-20855.

In recent years, a technique of doping a complex having an organic compound as the ligand into a silver halide grain so as to attain more enhanced performance by a sole dopant is disclosed. Many examples of using a complex having an organic compound as the ligand are disclosed in U.S. Pat. Nos. 5,360,712, 5,457,021 and 5,462,849, European Patent 0709724, JP-A-7-72569 and JP-A-8-179452 and it is stated that doping of $[(NC)_5Fe(m\text{-}4,4'\text{-bipyridine})Fe(CN)_5]^{6-}$ gives a particularly large effect in the elevation of sensitivity. The above-described technique of doping $[IrCl_5(thia)]^2$ is one of these techniques aiming at enhancement in the performance of an emulsion by a sole dopant. Furthermore, JP-A-11-24194 discloses an emulsion which is favored with high sensitivity and improved in the reciprocity failure by doping $[Fe(CO)_4(P(Ph)_3)]^0$ or $[Fe(CO)_3(P(Ph)_2)]^0$, JP-A-11-102042 discloses a technique where in complexes of $[M(CN)_5L]^{3-}$ (M: $Fe^{2+}$, $Ru^{2+}$ or $Ir^{3+}$), $[Fe(CO)_4L]]^0$, $[M'(CN)_3L]^-$ (M'; $Pd^{2+}$ or $Pt^{2+}$) or $[IrCl_5L]^-$ type, when L is 2-mercaptobenzimidazole, 5-methyl-s-triazolo(1.5-A)pyrimidin-7-ol or 2-mercapto-1,3,4-oxadiazole, a high-sensitive emulsion is obtained, and JP-A-10-293377 discloses that an emulsion doped with $[RuCl_5L']^{2-}$ (L': imidazole, benzimidazole or a derivative thereof) is remarkably increased in the contrast and the sensitivity thereof is greatly higher than that of an emulsion using a conventional dopant for obtaining high contrast with desensitization.

These dopants each effectively improves the photographic properties even when used solely, but by using a plurality of dopants at the same time, an emulsion having properties of respective dopants in combination can be obtained. An emulsion having high sensitivity and less reciprocity failure is realized by using a hexacyano complex and an iridium complex in combination as disclosed, for example, in JP-A-2-125425 [Patent Document 1], JP-A-3-132647 [Patent Document 2] and JP-A-3-188437 [Patent Document 3]. An emulsion having high contrast and excellent property in low illuminance and/or high illuminance reciprocity failure can be obtained by using a ruthenium or osmium complex having a nitrosyl as the ligand and an iridium complex in combination as described in U.S. Pat. No. 5,474,888 [Patent Document 4] and U.S. Pat. No. 5,500,335 [Patent Document 5] and JP-A-4-51233 [Patent document 6]. A technique of using a ruthenium or osmium complex having a nitrosyl as the ligand of complex and an iron or ruthenium complex having a cyanide ion as the ligand in combination for obtaining an emulsion having high sensitivity and high contrast is disclosed in U.S. Pat. No. 5,480,771 [Patent Document 7] and European Patents 0606893 [Patent Document 8], 0606894 [Patent Document 9], 0606895 [Patent Document 10] and 0610670 [Patent Document 11]. Also, an emulsion having high sensitivity, high contrast and less reciprocity failure can be obtained by using three kinds of dopants in combination. JP-A-8-314043 [Patent Document 12], JP-A-8-328182 [Patent Document 13], JP-A-8-211529 [Patent Document 14], JP-A-8-211530 [Patent Document 15] and U.S. Pat. No. 5,480,771 [Patent Document 16] disclose emulsions having high contrast, high sensitivity and less reciprocity failure, obtained by using hexacyanoruthenium(II) as a dopant for obtaining high sensitivity, pentachloronitrosyl osmium(II) as a dopant for obtaining high contrast, and hexachloroiridium(III or IV) as a dopant for improving reciprocity failure. Other examples of the emulsion using three kinds of dopants include an emulsion described in JP-A-11-282114 [Patent Document 17]. In this publication, an emulsion having high contrast and less reciprocity failure over a wide exposure illuminance is obtained by using pentachloronitrosyl osmium, hexachloroiridium and pentachloro(thiazole)iridium in combination.

JP-A-2002-202574 [Patent Document 18] discloses an example of using $K_2Ir(H_2O)Cl_5$ and $K_2Ir(thiazole)Cl_5$ in combination, European Patent 1,282,004 [Patent Document 19] discloses an example of using $K_2Ir(thiazole)Cl_5$ and $K_2Ir(5\text{-methyl-thiazole})Cl_5$ in combination, and JP-A-2002-214733 [Patent Document 20] discloses an example of using three or more transition metal complexes differing in the classified electron releasing time, in combination.

Even with these currently known techniques of enhancing the performance by each dopant and attaining more enhancement by using a plurality of dopants in combination, a technique capable of more improving the reciprocity failure over wide illuminance from low illuminance exposure for an exposure time of about 10 seconds to high illuminance exposure for about $10^{-6}$ second's (that is, a technique capable of achieving agreement of sensitivity in this range) without adversely affecting other performances such as sensitivity, gradation and latent image storability is being demanded.

SUMMARY OF THE INVENTION

An object of the present invention is to provide a silver halide color photographic light-sensitive material having higher sensitivity and higher contrast and free of reciprocity failure over wide exposure illuminance.

This object can be attained by the following techniques.

(1) A silver halide emulsion comprising a silver halide grain containing at least two metal complexes each giving an average electron releasing time of $10^{-5}$ to 3 seconds, the ratio in the average electron releasing time between the two metal complexes being at least 3 times or more and in these metal complexes, the content of the metal complex having a shorter average electron releasing time being 3 times or more as the molar ratio to the content of the metal complex having a longer average electron releasing time.

(2) A silver halide emulsion comprising a silver halide grain containing at least two metal complexes each giving an average electron releasing time of $10^{-5}$ to 3 seconds and having at least one organic ligand, the ratio in the average electron releasing time between the two metal complexes being at least 3 times or more.

(3) The silver halide emulsion as described in (1) or (2), wherein among the metal complexes, at least one metal complex gives an average electron releasing time of $10^{-5}$ to less than $10^{-2}$ seconds and at least one metal complex gives an average electron releasing time of $10^{-2}$ to 3 seconds.

(4) A silver halide emulsion comprising a silver halide grain containing at least three metal complexes each giving an average electron releasing time of $10^{-5}$ to 3 seconds (5) The silver halide emulsion as described in (4), wherein among the at least three metal complexes, the ratio in the average electron releasing time between two metal complexes is at least 2 times or more.

(6) The silver halide emulsion as described in (4) or (5), wherein in any two metal complexes out of the at least three metal complexes, the content of the metal complex having a shorter average electron releasing time is 2 times or more as the molar ratio to the content of the metal complex having a longer average electron releasing time.

(7) The silver halide emulsion as described in any one of (4) to (6), wherein among the at least three metal complexes, at least one metal complex gives an average electron releasing time of $10^{-5}$ to less than $10^{-3}$ seconds, at least one metal complex gives an average electron releasing time of $10^{-3}$ to less than $10^{-1}$ seconds, and at least one metal complex gives an average electron releasing time of $10^{-1}$ to 3 seconds.

(8) The silver halide emulsion as described in any one of (1) to (7), wherein among the metal complexes, at least one metal complex has at least two kinds of ligands.

(9) The silver halide emulsion as described in any one of (1) to (7), wherein out of the metal complexes, at least one metal complex is selected from the metal complexes represented by the following formula (I):

$$[IrX_{(6-n)}L_n]^m \qquad \text{Formula (I)}$$

wherein

X: a halogen ion or a pseudo-halogen ion,

L: an arbitrary ligand different from X, n: an integer of 1 to 6, and m: an integer of −4 to +4.

(10) The silver halide emulsion as described in any one of (1) to (7), wherein the metal complexes all are selected from metal complexes each having at least two kinds of ligands.

(11) The silver halide emulsion as described in any one of (1) to (7), wherein the metal complexes all are selected from metal complexes represented by the following formula (I):

$$[IrX_{(6-n)}L_n]^m \qquad \text{Formula (I)}$$

wherein

X: a halogen ion or a pseudo-halogen ion,

L: an arbitrary ligand different from X, n: an integer of 1 to 6, and m: an integer of −4 to +4.

(12) A silver halide emulsion comprising a silver halide grain containing at least two inorganic compounds except for a metal ion, a halogen ion and a pseudo-halogen ion.

(13) A silver halide emulsion comprising a silver halide grain containing at least three organic compounds except for a pseudo-halogen ion.

(14) A silver halide emulsion comprising a silver halide grain containing: at least one inorganic compound other than a metal ion, a halogen ion and a pseudo-halogen ion; and at least one organic compound, the content of the at least one inorganic compound being 3 times or more as the molar ratio to the content of the at least one organic compound.

(15) The silver halide emulsion as described in (12), wherein the silver halide grain contains at least two inorganic compounds except for a metal ion, a halogen ion and a pseudo-halogen ion, each giving an average electron releasing time of $10^{-5}$ to 3 seconds.

(16) A silver halide emulsion comprising a silver halide grain containing at least two organic compounds except for a pseudo-halogen ion, each giving an average electron releasing time of $10^{-5}$ to 3 seconds, the ratio in the average electron releasing time between the two organic compounds being at least 3 times or more.

(17) The silver halide emulsion as described in (14), wherein the silver halide grain contains at least one inorganic compound except for a metal ion, a halogen ion and a pseudo-halogen ion, giving an average electron releasing time of $10^{-5}$ to 3 seconds, at least one organic compound except for a pseudo-halogen ion, giving an average electron releasing time of $10^{-5}$ to 3 seconds, and the content of the at least one inorganic compound is 3 times or more as the molar ratio to the content of the at least one organic compound.

(18) The silver halide emulsion as described in any one of (15) to (17), wherein out of the compounds, at least one compound gives an average electron releasing time of $10^{-5}$ to less than $10^{-2}$ seconds and at least one compound gives an average electron releasing time of $10^{-2}$ to 3 seconds.

(19) The silver halide emulsion as described in (13), (14), (16), (17) or (18), wherein the organic compound is selected from 5- or 6-membered heterocyclic compounds.

(20) The silver halide emulsion as described in (1) to (19), wherein the silver chloride content is from 95 to 99.8 mol %.

(21) A silver halide color photographic light-sensitive material comprising a reflective support having thereon photographic constituent layers containing at least one yellow color-forming silver halide emulsion layer, at least one magenta color-forming silver halide emulsion layer and at least one cyan color-forming silver halide emulsion layer, wherein at least one of the silver halide emulsion layers contains the silver halide emulsion described in any one of (1) to (19).

(22) The silver halide color photographic light-sensitive material as described in (21), wherein when the silver halide color photographic light-sensitive material is exposed with light at a wavelength to which the silver halide emulsion layer containing the silver halide emulsion described in any one of (1) to (19) is sensitive and then subjected to color development, the obtained reflection density satisfies the relationship in the following formula:

$$DS_{0.1}-DS_{0.0001}\leqq 0.3$$

(wherein $DS_{0.1}$ represents a reflection density at an exposure amount, in terms of illuminance, 0.5 logE larger than the exposure amount necessary for obtaining a reflection density of 0.7 when exposed for 0.1 second with light at a wavelength to which the silver halide emulsion layer is sensitive and then subjected to color development, and $DS_{0.0001}$ represents a reflection density at an exposure amount, in terms of illuminance, 0.5 logE larger than the exposure amount necessary for obtaining a reflection density of 0.7 when exposed for 0.0001 second with light at a wavelength to which the silver halide emulsion layer is sensitive and then subjected to color development).

(23) The silver halide color photographic light-sensitive material as described in (21) or (22), which is a silver halide color photographic light-sensitive material for rapid processing of starting the color development within 9 seconds from the imagewise exposure and thereby forming an image.

(24) The silver halide color photographic light-sensitive material as described in any one of (21) to (23), which is a silver halide color photographic light-sensitive material for rapid processing of completing the color development in 28 seconds or less and thereby forming an image.

(25) The silver halide color photographic light-sensitive material as described in any one of (21) to (24), wherein the total coated silver amount in the photographic constituent layers is from 0.25 to 0.46 g/m$^2$.

(26) The silver halide emulsion as described in any one of (1) to (20), wherein the silver halide grain further contains a metal complex represented by the following formula (II):

$$[MX'_{(6-q)}L'_q]^r \qquad \text{Formula (II)}$$

wherein

M: Cr, Mo, Mn, Re, Fe, Ru, Os, Co, Rh, Ir, Pd, Pt or Cu,

X': a halogen ion,

L': an arbitrary inorganic or organic compound, q: an integer of 0 to 6 (provided that when M is Ir, q is 0), and r: an integer of −5 to +4.

(27) The silver halide emulsion as described in any one of (1) to (20), wherein the silver halide grains further contains a metal complex represented by the following formula (III):

$$[M'X''_{(6-y)}L''_y]^z \qquad \text{Formula (III)}$$

wherein

M': Mg, Ca, Ti, Zr, V, Cr, Mo, Mn, Re, Fe, Ru, Os, Co, Rh, Ir, Ni, Pd, Pt, Cu, Zn or Cd,

X": a halogen ion or a cyanide ion,

L": an arbitrary inorganic or organic compound, y: an integer of 0 to 6 (provided that when M' is Ir, y is 0), and z: an integer of −5 to +4.

(28) The silver halide emulsion as described in any one of (1) to (20), which contains both a metal complex represented by formula (II) and a metal complex represented by formula (III).

(29) The silver halide emulsion as described in (9) or (11), wherein X in formula (I) is selected from chloride ion and bromide ion.

(30) The silver halide emulsion as described in (9) or (11), wherein L in formula (I) is a ligand selected from SCN, OCN and a heterocyclic compounds.

(31) The silver halide emulsion as described in (9) or (11), wherein L in formula (I) is a 5-membered heterocyclic compound and in the ring, at least two nitrogen atoms and at least one sulfur atom are present.

(32) The silver halide emulsion as described in (31), wherein a substituent smaller than a methyl group and a substituent larger than a chlorine atom are bonded to the ring skeleton of L in formula (I).

(33) The silver halide emulsion as described in (26) or (28), wherein M in formula (II) is a transition metal ion selected from Cr, Ru, Os and Rh.

(34) The silver halide emulsion as described in (26) or (28), wherein L' in formula (II) is selected from a halogen ion, $H_2O$, SCN, CCN, NO, NS and a heterocyclic compound.

(35) The silver halide emulsion as described in (27) or (28), wherein M' in formula (III) is selected from Ti, Zr, Fe, Ru, Co, Ni, Pd, Pt, Cu and Zn.

(36) The silver halide emulsion as described in (27) or (28), wherein M' in formula (III) is selected from Fe and Ru.

(37) The silver halide emulsion as described in (27) or (28), wherein X" in formula (III) is a cyanide ion.

(38) The silver halide emulsion as described in (27) or (28), wherein L" in formula (III) is a cyanide ion, SCN, OCN or a heterocyclic compound.

(39) The silver halide emulsion as described in any one of (1) to (20) and (26) to (38), wherein a silver chlorobromide phase having a Br content of 30 mol % or less is formed inside the silver halide grain.

(40) The silver halide emulsion as described in any one of (1) to (20) and (26) to (39), wherein the silver halide grain contains 5 mol % or less of $I^-$ inside the grain.

(41) A silver halide color photographic light-sensitive material comprising the silver halide emulsion described in any one of (26) to (40).

The present invention is based on the knowledge that when the concept of releasing time is applied to the function of a dopant, an emulsion free from reciprocity failure over the entire exposure illuminance can be obtained by using an appropriate combination of dopants each having a releasing time properly adapted to an exposure illuminance necessary for the emulsion. This knowledge is expanded to the performance required of the emulsion (a way of thinking on sensitivity and gradation), as a result, an emulsion having high sensitivity and high contrast and free from reciprocity failure over a wide range of exposure illuminance can be obtained.

DETAILED DESCRIPTION OF THE INVENTION

The present invention is described in detail below.

The high illuminance reciprocity failure of a silver halide photographic emulsion occurs when a large amount of photoelectrons are generated inside a silver halide grain at exposure with high illuminance and thereby dispersion of the latent image is caused. Therefore, the high illuminance reciprocity failure can be improved by establishing in the silver halide grain such a function that photoelectrons generated in a large amount at high illuminance exposure are temporarily sheltered from the conduction band and after staying for a certain time, released again into the conduction band This corresponds to a function of converting the condition inside a silver halide grain at high illuminance exposure into the same condition as that at low illuminance exposure. This function of temporarily sheltering photoelectrons, namely, temporarily trapping photoelectrons can be realized by doping a transition metal complex (such a dopant is called an electron releasing dopant or an illuminance-converting dopant). The transition metal complex heretofore used for improving the high illuminance reciprocity failure is hexachloroiridium. When hexachloroiridium is used, photoelectrons generated by exposure are trapped by the lowest unoccupied orbital of iridium which is the center metal, and after staying in this orbital for a certain time, released again into the conduction band (this time from exposure to re-release of electrons trapped is defined as an electron releasing time). In this way, hexachloroiridium has an excellent function of temporarily sheltering photoelectrons generated in a large amount, however, the residence time in the electron trapping level is long and therefore, despite the improvement of high illuminance failure, the sensitivity depended on the time from exposure to development increases (sensitization of latent image) to cause unstable photographic performance. That is, for obtaining a preferred high illuminance reciprocity law under stable photographic performance, electrons must be again released into the conduction band within an appropriate time from the electrons present in the conduction band are trapped into the iridium center. When the exposure light source is constant, this re-release can be attained by using a dopant capable of giving an electron releasing time respondent only to a certain exposure illuminance. However, in the case of obtaining an emulsion capable of always giving the same photographic properties with different exposure light sources, dopants having an appropriate electron releasing time respondent to illuminance of respective exposure light sources must be introduced into a silver halide grain.

The electron releasing time can be determined by a reciprocity failure curve or a double flash photoconduction method. In the present invention, an average electron releasing time determined by the double flash photoconduction method is employed and the value is confirmed by the electron releasing time determined from the reciprocity failure curve. The electron releasing time by the double flash photoconduction method can be measured by using a microwave photoconduction method or a radiowave photoconduction method. In the double flash photoconduction method, first short-time exposure is applied and after passing of a certain time, second short-time exposure is applied. When electrons are trapped by an electron trap in a silver halide crystal upon first exposure, if second exposure is performed immediately thereafter, the electron trap is filled with electrons trapped at the first exposure and cannot trap electrons and the number of electrons in the conduction band does not decrease, therefore, a large photoconduction signal is observed at the second exposure. On the other hand, when the second exposure is performed after a sufficiently large interval and the electrons trapped by the electron trap at the first exposure are already released, the photoconduction signal observed at the second exposure is returned to almost the original signal strength. When the interval to the second exposure is changed and the dependency of the second photoconduction signal strength on the exposure interval is examined, it can be observed that the second photoconduction signal strength decreases according to the exposure interval. This change in the signal strength is showing the behavior of releasing photoelectrons from the electron trap and when the average time of causing attenuation of the signal is determined, the average electron releasing time can be expressed by the value. The reciprocity failure curve can be drawn as described in *Kaitei, Shashin Kogaku no Kiso-Gin-En Shashin Hen-* (*Revised, Fundamental of Photographic Engineering—Silver Salt Photography-*), compiled by The Society of Photographic Science and Technology of Japan, p. 297. A normal silver halide emulsion, particularly, a silver chloride emulsion gives a downwardly convexed curve where highest sensitivity is present in the vicinity of medium illuminance and desensitization is occurring at the high and low illuminance sides. On the contrary, an emulsion improved in the high illuminance reciprocity failure by doping an electron releasing dopant gives a reciprocity failure curve such that a flat region having no generation of desensitization and no change in the sensitivity is present in the high illuminance side from a certain exposure illuminance, and this curve differs from the reciprocity failure curve of an undoped emulsion. The exposure time at the exposure illuminance where this flat region starts, namely, the exposure time at the exposure illuminance where the difference from the characteristic curve of an undoped emulsion starts, is assumed to be an electron releasing time. The effect of electron-gradual release (re-release of photoelectrons) appears for the first time when the exposure is finished. Therefore, the time when the effect of electron-gradual release photographically appears can be defined as a time where re-release of photoelectrons starts, that is, an electron releasing time.

In order to improve the high illuminance reciprocity failure and cause no sensitization of latent image, the average releasing time must be present between $10^{-5}$ seconds and 3 seconds. If the average releasing time is less than $10^{-5}$ second, the effect of improving the high illuminance reciprocity failure is scarcely obtained. The average releasing time is preferably $10^{-4}$ seconds or more. On the other hand, if the average releasing time exceeds 3 seconds, the latent image storability in the vicinity of the latent image storing time in this time region is deteriorated. The average releasing time is preferably 1 second or less, more preferably 0.5 seconds or less. In order to once trap all electrons generated at high illuminance exposure and release the electrons within a time of not causing inefficiency such as dispersion of latent image, the trapping/release can be hardly attained by a sole dopant but the trapping/release must be performed stepwise by a plurality of dopants differing in the average releasing time.

One preferred embodiment of the present invention is a silver halide emulsion characterized in that at least two metal complexes each giving an average electron releasing time of $10^{-5}$ to 3 seconds are contained in a silver halide grain, the ratio in the average electron releasing time between the two metal complexes is at least 3 times or more and in these metal complexes, the content of the metal complex having a shorter average electron releasing time is 3 times or more as the molar ratio to the content of the metal complex having a longer average electron releasing time. The ratio in the average electron releasing time between the two metal complexes is preferably 5 times or more, more preferably 10 times or more. The content of the metal complex having a shorter average electron releasing time is preferably 5 times or more, more preferably 10 times or more, as the molar ratio to the content of the metal complex having a longer average electron releasing time. In the present invention, when three or more metal complexes are contained, the above-described relationship must be present in a combination of certain two metal complexes, but the ratio in the average electron releasing time and the ratio in the metal complex content are not particularly limited for a combination with other metal complex. The same applies to the followings.

Another preferred embodiment of the present invention is a silver halide emulsion characterized in that at least two metal complexes each giving an average electron releasing time of $10^{-5}$ to 3 seconds and having at least one organic ligand are contained in a silver halide grain and the ratio in the average electron releasing time between those two metal complexes is at least 3 times of more. The metal complex having at least one organic ligand is, for example, a metal complex represented by formula (Ib) shown later. Also, a metal complex having two coordinated organic ligands or a metal complex having two or more same or different organic ligands is preferably used. The ratio in the average electron releasing time is preferably 5 times or more, more preferably 10 times or more.

Out of this plurality of dopants, at least one is preferably a dopant of exerting the function in the high illuminance region (a metal complex of giving an average electron releasing time of $10^{-5}$ to less than $10^{-2}$ seconds) and at least one is preferably a dopant of exerting the function in the low illuminance region (a metal complex of giving an average electron releasing time of $10^{-2}$ to 3 seconds).

Still another embodiment of the present invention is a silver halide emulsion characterized in that at least three metal complexes each giving an average electron releasing time of $10^{-5}$ to 3 seconds are contained in a silver halide grain. It is preferred that at least one metal complex gives an average electron releasing time of $10^{-5}$ to less than $10^{-3}$ seconds, at least one metal complex gives an average electron releasing time of $10^{-3}$ to less than $10^{-1}$ seconds, and at least one metal complex gives an average electron releasing time of $10^{-1}$ to 3 seconds.

Out of those three metal complexes, the ratio in the average electron releasing time between certain two metal complexes is preferably 2 times or more, more preferably 3 times or more, still more preferably 5 times or more, and most preferably 10 times or more. In arbitrary two metal complexes out of those three metal complexes, the ratio of the content of the metal complex having a shorter average electron releasing time to the content of the metal complex having a longer average electron releasing time is preferably 2 times or more, more preferably 3 times or more, still more preferably 5 times or more, and most preferably 10 times of more. In the case of containing three or more metal complexes for use in the present invention, it may suffice if arbitrary two or more metal complexes satisfy these conditions, but all combinations preferably satisfy these conditions.

Out of the plurality of metal complexes, the case where at least one metal complex is selected from metal complexes having at least two kinds of ligands within the same metal complex is preferred, the case where at least two metal complexes are selected from metal complexes having at least two kinds of ligands within the same metal complex is more preferred, and the case where all metal complexes are selected from metal complexes having at least two kinds of ligands within the same metal complex is most preferred. The center metal is preferably Ir. The at least two kinds of ligands may be a halogen ion, a pseudo-halogen ion or an inorganic or organic ligand other than a halogen ion and a pseudo-halogen ion and may be a monodentate ligand, a bidentate ligand or a tridentate ligand.

Still another preferred embodiment of the present invention is a silver halide emulsion characterized in that at least two inorganic compounds except for a metal ion, a halogen ion and a pseudo-halogen ion are contained in a silver halide grain, or a silver halide grain characterized in that at least three organic compounds except for a pseudo-halogen ion are contained in a silver halide grain.

Still another preferred embodiment of the present invention is a silver halide emulsion characterized in that at least one inorganic compound and at least one organic compound except for a metal ion, a halogen ion and a pseudo-halogen ion are contained in a silver halide grain and the content of the at least one inorganic compound is 3 times or more as the molar ratio to the content of the at least one organic compound. The content of the inorganic compound is preferably 5 times or more, more preferably 10 times or more, as the molar ratio to the content of the organic compound.

Still another preferred embodiment of the present invention is a silver halide emulsion characterized in that at least two inorganic compounds except for a metal ion, a halogen ion, and a pseudo-halogen ion, each giving an average electron releasing time of $10^{-5}$ to 3 seconds, are contained in a silver halide grain.

Still another preferred embodiment of the present invention is a silver halide emulsion characterized in that at least two organic compounds except for a pseudo-halogen ion, each giving an average electron releasing time of $10^{-5}$ to 3 seconds, are contained in a silver halide grain and the ratio in the average electron releasing time between the two organic compounds is at least 3 times or more. The ratio in the average electron releasing time between two organic compounds is preferably 5 times or more, more preferably 10 times or more.

Still another preferred embodiment of the present invention is a silver halide emulsion characterized in that at least one inorganic compound and at least one organic compound except for a metal ion, a halogen ion and a pseudo-halogen ion, each giving an average electron releasing time of $10^{-5}$ to 3 seconds, are contained in a silver halide grain, and the content of the at least one inorganic compound is 3 times or more as the molar ratio to the content of the at least one organic compound. The content of the inorganic compound is preferably 5 times or more, more preferably 10 times or more, as the molar ratio to the content of the organic compound.

The inorganic or organic compound must be taken into the grain. The percentage of the inorganic or organic compound taken into the grain is preferably 30% or more, more preferably 50% or more, and most preferably 70% or more, based on the inorganic or organic compound added at the formation of grains. The "inorganic or organic compound taken into the grain" excludes the inorganic or organic compound adsorbed to the grain surface and also excludes a so-called silver halide solvent used at the formation of grains. The inorganic or organic compound can be taken into the grain by introducing it as a ligand of the metal complex. Specific examples of the inorganic and organic compounds are the same as those for L, $L^a$, $L^b$ and $L^c$ in formulae (I), (Ia), (Ib) and (Ic), respectively, which are described later. The organic compound is preferably selected from 5- or 6-membered heterocyclic compounds.

Out of these compounds, at least one compound preferably gives an average electron releasing time of $10^{-5}$ to less than $10^{-2}$ seconds and at least one compound preferably gives an average electron releasing time of $10^{-2}$ to 3 seconds.

In the present invention, the dopant which gives a preferred average electron releasing time is preferably an Ir complex represented by the following formula (I):

$$[IrX_{(6-n)}L_n]^m \qquad \text{Formula (I)}$$

wherein

X: a halogen ion or a pseudo-halogen ion,

L: an arbitrary ligand different from X, n: an integer of 1 to 6, and m: an integer of −4 to +4.

In formula (I), Xs may be the same or different and when a plurality of Ls are present, the plurality of Ls may be the same or different. Examples of the halogen ion include fluoride ion, chloride ion, bromide ion and iodide ion. The pseudo-halogen ion is an ion having properties similar to a halogen ion and examples thereof include cyanide ion ($CN^-$), thiocyanate ion ($SCN^-$), selenocyanate ion ($SeCN^-$), tellurocyanate ion ($TeCN^-$), azidodithio-carbonate ion ($SCSN_3^-$), cyanate ion ($OCN^-$), fulminate ion ($ONC^-$) and azide ion ($N_3^-$). X is preferably fluoride ion, chloride ion, bromide ion, iodide ion, cyanide ion, isocyanate ion, thiocyanate ion, nitrate ion, nitrite ion or azide ion, more preferably chloride ion or bromide ion. L is not particularly limited and may be an inorganic compound or an organic compound or may or may not have an electric charge, but is preferably an inorganic or organic compound having no electric charge.

Among metal complexes represented by formula (I), preferred is a metal complex represented by the following formula (Ia):

$$[IrX^a_{(6-n')}L^a_{n'}]^{m'} \qquad \text{Formula (Ia)}$$

wherein $X^a$: a halogen ion or a pseudo-halogen ion, $L^a$: an arbitrary ligand different from X, n': 1, 2 or 3, and m': an integer of −4 to +1.

$X^a$ has the same meaning as X in formula (I) and the preferred range is also the same. $X^a$s may be the same or different. $L^a$ is preferably $H_2O$, OCN, $NH_3$, phosphine or CO, and most preferably $H_2O$.

When a plurality of $L^a$s are present, the plurality of $L^a$s may be the same or different.

Among metal complexes represented by formula (I), also preferred is a metal complex represented by the following formula (Ib):

$$[IrX^b_{(6-n'')}L^a_{n''}]^{m''} \qquad \text{Formula (Ib)}$$

wherein $X^b$: a halogen ion or a pseudo-halogen ion, $L^b$: a compound having a chained or cyclic hydro-carbon as the mother structure, or a compound where a carbon or hydrogen atom constituting a part of the mother structure is replaced by another atom or atomic group, n": 1, 2 or 3, and m": an integer of −4 to +1.

$X^b$ has the same meaning as X in formula (I) and the preferred range is also the same. $X^b$s may be the same or different. $L^b$ is a compound having a chained or cyclic hydrocarbon as the mother structure, or a compound where a carbon or hydrogen atom constituting a part of the mother structure is replaced by another atom or atomic group, and this compound becomes a ligand of the Ir complex. However, an inorganic compound corresponding to cyanide ion or carbonyl is not included in this compound. $L_b$ is preferably a heterocyclic compound, more preferably a 5- or 6-membered heterocyclic compound. In the case of a 5-membered ring, the compound preferably at least one nitrogen atom and at least one sulfur atom in the ring skeleton. In the case of a 6-membered ring, the compound preferably contains at least one nitrogen atom in the ring skeleton. $L^b$ is more preferably a compound having an arbitrary substituent on a carbon atom in the ring skeleton and the substituent is preferably a substituent having a volume smaller than an n-propyl group. Specific preferred examples of the substituent include a methyl group, an ethyl group, a methoxy group, an ethoxy group, a cyano group, an isocyano group, a cyanato group, an isocyanato group, a thiocyanato group, an isothiocyanato group, a formyl group, a thioformyl group, a hydroxy group, a mercapto group, an amino group, a hydrazino group, an azido group, a nitro group, a nitroso group, a hydroxyamino group, a carboxyl group, a carbamoyl group, a fluoro group, a chloro group, a bromo group and an iodo group. When a plurality of $L^b$s are present, the plurality of $L^b$s may be the same or different. n" is preferably 1, 2 or 3, more preferably 1 or 2, and most preferably 1.

Among metal complexes represented by formula (Ib), most preferred is a metal complex represented by the following formula (Ic):

$$[IrX^c_{(6-n'')}L^c_{n''}]^{m''} \qquad \text{Formula (Ic)}$$

wherein $X^c$: a halogen ion or a pseudo-halogen ion, $L^c$: a 5- or 6-membered heterocyclic compound having at least two nitrogen atoms and at least one sulfur atom in the ring skeleton and having an arbitrary substituent on a carbon atom in the ring skeleton, n": 1, 2 or 3, and m": an integer of −4 to +1 (preferably an integer of −2 to 0).

$X^c$ has the same meaning as X in formula (I) and the preferred range is also the same. A plurality of $X^c$s may be the same or different. $L^c$ is preferably a compound having a thiadiazole as the skeleton and in the compound, a substituent except for hydrogen is preferably bonded to a carbon atom. The substituent is preferably a halogen (e.g., fluorine, chlorine, bromine, iodine), a methoxy group, an ethoxy group, a carboxyl group, a methoxycarboxyl group, an acyl group, an acetyl group, a chloroformyl group, a mercapto group, a methylthio group, a thioformyl group, a thiocarboxy group, a dithiocarboxy group, a sulfino group, a sulfo group, a sulfamoyl group, a methylamino group, a cyano group, an isocyano group, a cyanato group, an isocyanato group, a thiocyanato group, an isocyanato group, a hydroxyamino group, a hydroxyimino group, a carbamoyl group, a nitroso group, a nitro group, a hydrazino group, a hydrozono group or an azido group, more preferably a halogen (e.g., fluorine, chlorine, bromine, iodine), a chloroformyl group, a sulfino group, a sulfo group, a sulfamoyl group, an isocyano group, a cyanato group, an isocyanato group, a thiocyanato group, an isocyanato group, a hydroxyimino group, a nitroso group, a nitro group or an azide group, more preferably chlorine, bromine, a chloroformyl group, an isocyano group, a cyanato group, a thiocyanato group or an isocyanato group. When a plurality of $L^c$s are present, the plurality of $L^c$s may be the same or different. n" is preferably 1 or 2, and m" is preferably −2 or −1.

Specific preferred examples of the metal complex represented by formula (Ia) are set forth below, however, the present invention is not limited thereto.

$[IrCl_5(H_2O)]^{2-}$
$[IrCl_4(H_2O)_2]^{-}$
$[IrCl_5(H_2O)]^{-}$
$[IrCl_4(H_2O)_2]^{0}$
$[IrCl_5(OH)]^{3-}$
$[IrCl_4(OH)_2]^{2-}$
$[IrCl_5(OH)]^{2-}$
$[IrCl_4(OH)_2]^{3-}$
$[IrCl_5(O)]^{4-}$
$[IrCl_4(O)_2]^{5-}$
$[IrCl_5(O)]^{3-}$
$[IrCl_4(O)_2]^{4-}$
$[IrBr_5(H_2O)]^{2-}$
$[IrBr_4(H_2O)_2]^{-}$
$[IrBr_5(H_2O)]^{-}$
$[IrBr_4(H_2O)_2]^{0}$
$[IrBr_5(OH)]^{3-}$
$[IrBr_4(OH)_2]^{3-}$
$[IrBr_5(OH)]^{2-}$
$[IrBr_4(OH)_2]^{2-}$
$[IrBr_5(O)]^{4-}$
$[IrBr_4(O)_2]^{5-}$
$[IrBr_5(O)]^{3-}$
$[IrBr_4(O)_2]^{4-}$
$[IrCl_5(OCN)]^{3-}$
$[IrBr_5(OCN)_2]^{3-}$
$[IrCl_5(NH_3)]^{2-}$
$[IrBr_4(NH_3)]^{2-}$
$[IrCl_5(S{=}P(NH_3)_3]^{2-}$
$[IrCl_5(S{=}P(NH_3)_2(OH)]^{2-}$
$[IrCl_5(S{=}P(NH_3(OH)_2)]^{2-}$
$[IrCl_5(S{=}P(OH)_3)]^{2-}$

These metal complexes have an average electron releasing time of $10^{-5}$ to less than $10^{-2}$ seconds.

Preferred specific examples of the metal complex represented by formula (Ic) are set forth below, however, the present invention is not limited thereto.

$[IrCl_5(thiazole)]^{2-}$
$[IrCl_4(thiazole)_2]^{-}$
$[IrCl_3(thiazole)_3]^{0}$
$[IrBr_5(thiazole)]^{2-}$
$[IrBr_4(thiazole)_2]^{-}$
$[IrBr_4(thiazole)_3]^{0}$
$[IrCl_5(5\text{-methylthiazole})]^{2-}$
$[IrCl_4(5\text{-methylthiazole})_2]^{-}$
$[IrBr_5(5\text{-methylthiazole})]^{2-}$
$[IrBr_4(5\text{-methylthiazole})_2]^{-}$
$[IrCl_5(5\text{-chlorothiadiazole})]^{2-}$
$[IrCl_4(5\text{-chlorothiadiazole})_2]^{-}$
$[IrBr_5(5\text{-chlorothiadiazole})]^{2-}$
$[IrBr_4(5\text{-chlorothiadiazole})_2]^{31}$ Other preferred specific examples of the metal complex represented by formula (Ic) include the following compounds.

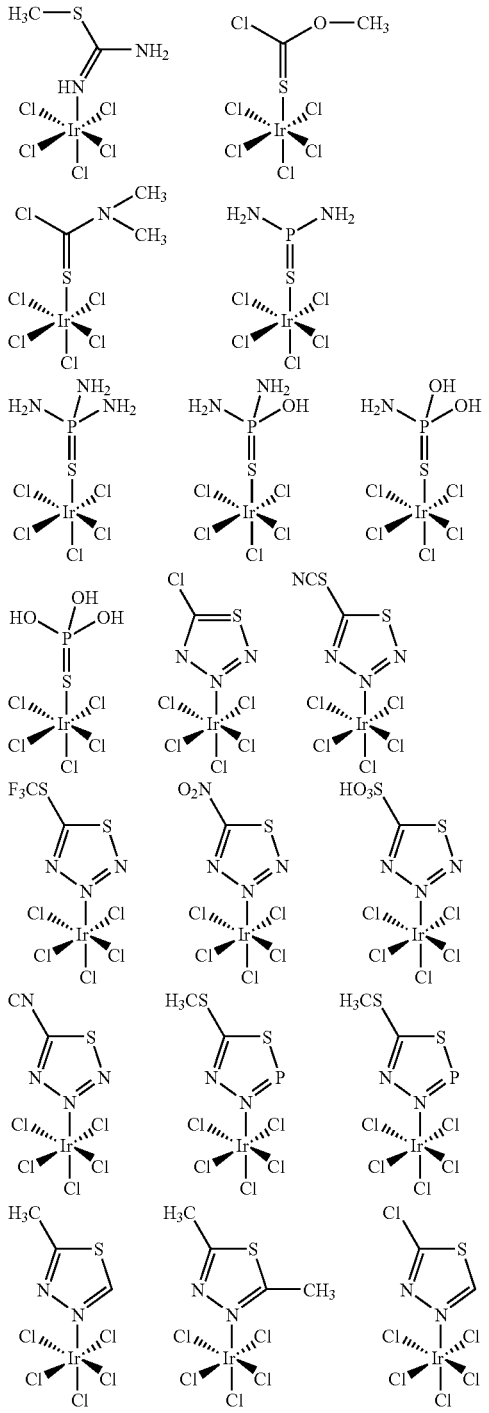

-continued

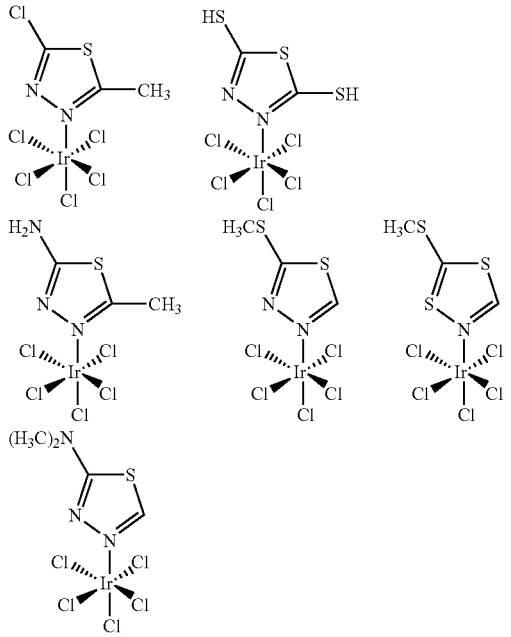

Among these specific examples, preferred are $[IrCl_5\text{-}S\text{-methylthiourea}]]^{2-}$, $[IrCl_5(5\text{-methylthiazole})]^{2-}$ and $[IrCl_5(5\text{-chlorothiadiazole})]^{2-}$.

These specific examples of the metal complex represented by formula (Ic) have an average electron releasing time of $10^{-2}$ to 3 seconds.

Not only the illuminance-converting dopant but also a contrast-increasing dopant and a sensitivity-increasing dopant can be discussed by using the electron releasing time. The contrast-increasing dopant exerts its contrast-increasing activity by trapping photoelectrons generated upon exposure at the dopant site and not re-releasing the photoelectrons, or by trapping photoelectrons and after passing of a very long time (several hours to several years), releasing photoelectrons. On the other hand, the sensitivity-increasing dopant such as hexacyanoiron introduces a shallow electron trap caused by a Coulomb field into the silver halide grain as described in *Bulgarian Chem. Commun.,* 20, 350–368 (1993), *Radiat. Eff. Defects Solids,* 135, 101–104 (1995), and *J. Phys.: Condens. Matter,* 9, 3227–3240 (1997). This dopant site having an extremely short electron releasing time repeats trapping and releasing of photoelectrons and therefore, the photoelectron can stay in the conduction band without undergoing apparent deactivation until an interstitial silver ion is supplied or until the photoelectron transfers to the interstitial silver ion, whereby elevation of sensitivity can be achieved. In the present invention, a contrast-increasing dopant and a sensitivity-increasing dopant are preferably also used. Formulae (II) and (III) of the present invention correspond to a contrast-increasing dopant and a sensitivity-increasing dopant, respectively, and preferred compounds thereof are described below.

The metal complex represented by formula (II), which is preferably used in the present invention, is described below.

$$[MX'_{(6-q)}L'_q]^r \qquad \text{Formula (II)}$$

wherein

M: Cr, Mo, Mn, Re, Fe, Ru, Os, Co, Rh, Ir, Pd, Pt or Cu,

X': a halogen ion,

L': an arbitrary inorganic or organic compound, q: an integer of 0 to 6 (provided that when M is Ir, q is 0; preferably an integer of 0 to 2), and r: an integer of −5 to +4 (preferably an integer of −4 to −1).

X' is preferably fluoride ion, chloride ion, bromide ion or iodide ion, more preferably chloride ion or bromide ion. X's may be the same or different. L' may be an inorganic compound or an organic compound and may or may not have an electric charge, but is preferably an inorganic compound having no electric charge. L' is preferably $H_2O$, NO, NS or a 5- or 6-membered heterocyclic compound. When a plurality of L's are present, the L's may be the same or different.

Among the metal complexes represented by formula (II), preferred is a metal complex represented by the following formula (IIa):

$$[M^{II}X^{a'}_{(6-q')}L^{a'}_{q'}]^{r'} \qquad \text{Formula (IIa)}$$

wherein $M^{II}$: Re, Ru, Os or Rh, $X^{a'}$: a halogen ion, $L^{a'}$: $H_2O$, NO, NS or a 5- or 6-membered heterocyclic compound, q': 0, 1, 2 or 3 (preferably an integer of 0 to 2), and r': an integer of −4 to +1 (preferably an integer of −4 to −1).

$X^{a'}$ has the same meaning as X' in formula (II) and the preferred range is also the same. $X^{a'}$s may be the same or different. $L^{a'}$ is preferably NO, NS, $H_2O$ or a 6- or 6-membered heterocyclic compound when $M^{II}$ is Ru, preferably NO or NS when $M^{II}$ is Os, and preferably $H_2O$ when $M^{II}$ is Rh. Among the heterocyclic compounds preferred when $M^{II}$ is Ru, more preferred are imidazole, pyridine and pyrazine. In the skeleton of these rings, an arbitrary substituent is preferably bonded and the substituent is preferably a halogen (e.g., fluorine, chlorine, bromine, iodine), a methoxy group, an ethoxy group, a carboxyl group, a methoxycarboxyl group, an acyl group, an acetyl group, a chloroformyl group, a mercapto group, a methyl thio group, a thioformyl group, a thiocarboxy group, a dithiocarboxyl group, a sulfino group, a sulfo group, a sulfamoyl group, a methylamino group, a cyano group, an isocyano group, a cyanato group, an isocyanto group, a thiocyanato group, an isocyanato group, a hydroxyamino group, a hydroxyimino group, a carbamoyl group, a nitroso group, a nitro group, a hydrazino group, a hydrazono group or an azide group. When a plurality of $L^{a'}$s are present, the $L^{a'}$s may be the same or different.

Preferred specific examples of the metal complex represented by formula (II) are set forth below, however, the present invention is not limited thereto.

$[ReCl_6]^{2-}$ $[ReCl_5(NO)]^{2-}$ $[RuCl_6]^{2-}$ $[RuCl_6]^{3-}$ $[RuCl_5(NO)]^{2-}$ $[RuCl_5(NS)]^{2-}$ $[RuBr_5(NS)]^{2-}$ $[OsCl_6]^{4-}$ $[OsCl_5(NO)]^{2-}$ $[OsBr_5(NS)]^{2-}$ $[RhCl_6]^{3-}$ $[RhCl_5(H_2O)]^{2-}$ $[RhCl_4(H_2O)_2]^{-}$ $[RhBr_6]^{3-}$ $[RhBr_5(H_2O)]^{2-}$ $[RhBr_4(H_2O)_2]^{-}$ $[PdCl_6]^{2-}$ $[PtCl_6]^{2-}$

Among these, preferred are $[OsCl_5(NO))]^{2-}$ and $[RhBr_6]^{3-}$.

Among the metal complexes represented by formula (III), preferred is a metal complex represented by the following formula (IIIa):

$$[M'X''_{(6-y)}L''_y]^z \qquad \text{Formula (IIIa)}$$

wherein

M': Mg, Ca, Ti, Zr, Fe, Ru, Co, Ni, Cu or Zn,

X": a halogen ion or a cyanide ion (provided that when M' is Ru, X' is a cyanide ion), L": an arbitrary inorganic or organic compound, y: an integer of 0 to 6, and z: an integer of −5 to +4 (preferably an integer of −4 to 0).

Specific preferred examples of the metal complex represented by formula (IIIa) include $[MgCl_6]^{4-}$, $[Mg(imidazole)_6]^{4-}$, $[CaCl_6]^{4-}$, $[TiCl_4(imidazole)_2]^{-}$, $[ZrCl_4(imidazole)_2]^{-}$, $[Fe(CN)_6]^{4-}$, $[Fe(CN)_5(SCN)]^{4-}$, $[Fe(CN)_5(OCN)]^{4-}$, $[Fe(CN)_5(dimethylsulfoxyside)]^{3-}$, $[Fe(CN)_5(pyradine)]^{3-}$, $[Fe(CN)_5(4,4'\text{-bipyridine})]^{3-}$, $[Ru(CN)_6]^{4-}$, $[Ru(CN)_5(pyradine)]^{3-}$, $[Ru(CN)_5(4,4'\text{-bipyridine})]^{3-}$, $[Co(CN)_6]^{4-}$, $[CoCl_2(imidazole)_2]^{0}$, $[CoCl_2(2\text{-methylimidazole})_2]^{0}$, $[Co(imidazole)_6]^{4-}$, $[NiCl_2(pyridine)_2]^{3-}$, $[CuCl_2(pyridine)_2]^{3-}$ and $[Zn(imidazole)_6]^{4-}$.

When these metal complexes each is anion and forms a salt with cation, this counter cation ion is preferably a cation easily dissolvable in water. Specifically, the cation is preferably an alkali metal ion such as sodium ion, potassium ion, rubidium ion, cesium ion and lithium ion, an ammonium ion or an alkylammonium ion. These metal complexes each can be used by dissolving it in water or in a mixed solvent of water and an appropriate solvent capable of mixing with water (for example, alcohols, ethers, glycols, ketones, esters and amides) The metal complex represented by formula (I) is preferably added in an amount of $1\times10^{-10}$ to $1\times10^{-3}$ mol, most preferably from $1\times10^{-8}$ to $1\times10^{-5}$ mol % per mol of silver during the formation of grains. The metal complex represented by formula (II) is preferably added in an amount of $1\times10^{-11}$ to $1\times10^{-6}$ mol, most preferably from $1\times10^{-9}$ to $1\times10^{-7}$ mol, per mol of silver during the formation of grains. The metal complex represented by formula (III) is preferably added in an amount of $1\times10^{-8}$ to $1\times10^{-2}$ mol, most preferably from $1\times10^{-6}$ to $5\times10^{-4}$ mol, per mol of silver during the formation of grains.

In the present invention, these metal complexes each is preferably added to the reaction solution for formation of grains by the direct addition to the reaction solution at the formation of silver halide grains or by the addition to an aqueous silver halide solution for forming silver halide grains or other solutions, and thereby integrated into a silver halide grain. Also, a method of physically ripening fine grains having previously integrated therein the metal complex and thereby integrating the metal complex into a silver halide grain is preferred. Furthermore, the metal complex may be incorporated into a silver halide grain by combining these methods.

In the case of integrating the metal complex into a silver halide grain, the metal complex may be caused to be uniformly present inside the grain but as described in JP-A-4-208936, JP-A-2-125245 and JP-A-3-188437, it is also preferred that the metal complex is caused to be present only in the surface layer of a grain or that the metal complex is caused to be present only inside a grain and a layer not containing the metal complex is added to the grain surface. Furthermore, as described in U.S. Pat. Nos. 5,252,451 and 5,256,530, a method of physically ripening a fine grain having integrated therein the metal complex and modifying the grain surface phase is also preferred. These methods may be used in combination and multiple kinds of metal complexes may be integrated into one silver halide grain.

The silver halide emulsion of the present invention contains a specific silver halide grain. The shape of the grain is not particularly limited, but it is preferred that the silver halide emulsion substantially comprises cubic or tetradecahedral crystalline grains having a {100} face (these grains may have rounded corners and may further have a face of higher order), octahedral crystalline grains, or tabular grains having a main surface of {100} or {111} face and having an aspect ratio of 3 or more. The aspect ratio is a value obtained by dividing a diameter of a circle corresponding to the projected area by a grain thickness.

The silver chloride content is preferably 90 mol % or more. In view of rapid processability, the silver chloride content is preferably 93 mol % ore more, still more preferably 95 mol % or more, and most preferably from 95 to 99.8 mol %. The silver bromide content is preferably from 0.1 to 7 mol %, more preferably from 0.5 to 5 mol %, because high contrast and excellent stability of latent image are obtained. The silver iodide content is preferably from 0.02 to 1 mol %, more preferably from 0.05 to 0.50 mol %, and most preferably from 0.07 to 0.40 mol %, because high sensitivity and high contrast are obtained at high illuminance exposure. The specific silver halide grain of the present invention is preferably a silver iodobromo-chloride grain, more preferably a silver iodobromochloride grain having the above-described halogen composition.

The specific silver halide grain in the silver halide emulsion of the present invention preferably has a silver bromide-containing phase and/or a silver iodide-containing phase. The silver bromide- or silver iodide-containing phase as used herein means a portion where the concentration of silver bromide or silver iodide is higher than in the periphery. The halogen composition may be changed continuously or abruptly between the silver bromide- or silver iodide-containing phase and the periphery thereof. The silver bromide- or silver iodide-containing phase may form a layer having an almost constant concentration width in a certain portion inside the grain or may be a peak point having no expansion. The localized silver bromide content of the silver bromide-containing phase is preferably 5 mol % or more, more preferably from 10 to 80 mol %, and most preferably from 15 to 50 mol %. The localized silver iodide content of the silver iodide-containing phase is preferably 0.3 mol % or more, more preferably from 0.5 to 8 mol %, and most preferably from 1 to 5 mol %. A plurality of silver bromide- or silver iodide-containing phases may be present like layers inside the grain and these phases may be differing in the silver bromide or silver iodide content but at least one silver bromide-containing layer and at least one silver iodide-containing layer must be present.

In the silver halide emulsion of the present invention, it is important that the silver bromide- or silver iodide-containing phase is present like a layer surrounding the grain. In one preferred embodiment, the silver bromide- or silver iodide-containing phase formed like a layer surrounding the grain has a uniform concentration distribution in the circumferential direction within the phase. However, in the silver bromide- or silver iodide-containing phase formed like a layer surrounding the grain, a concentration distribution may be present by having a maximum point or a minimum point of the silver bromide or silver iodide concentration in the circumferential direction of the grain. For example, in the case where a silver bromide- or silver iodide-containing phase like a layer surrounding the grain is formed in the vicinity of the grain surface, the silver bromide or silver iodide concentration at corners or edges of the grain may differ from the concentration on the main surface. Also, apart from the silver bromide-containing phase and silver iodide-containing phase formed like layers surrounding the grain, a silver bromide- or silver iodide-containing layer not surrounding the grain but being completely islanded in a specific portion on the grain surface may be present.

In the case where the silver halide emulsion of the present invention contains a silver bromide-containing phase, the silver bromide-containing phase is preferably formed like a layer to have a silver bromide concentration peak inside the grain. In the case where the silver halide emulsion of the present invention contains a silver iodide-containing phase, the silver iodide-containing phase is preferably formed like a layer to have a silver iodide concentration peak at the grain surface. In order to elevate the local concentration with a smaller silver bromide or silver iodide content, the silver bromide- or silver iodide-containing phase is preferably constituted to have a silver amount of 3 to 30%, more preferably from 3 to 15%, based on the volume of the grain.

The silver halide emulsion of the present invention preferably contains both a silver bromide-containing phase and a silver iodide-containing phase. In this case, the silver bromide-containing phase and the silver iodide-containing phase may be present in the same position of the grain or may be present in different positions but, from the standpoint of facilitating the control of the grain formation, these phase are preferably present in different positions. The silver bromide-containing phase may contain silver iodide or conversely, the silver iodide-containing phase may silver bromide. In general, the iodide added during the formation of high silver chloride grains more readily bleeds out to the grain surface than bromide and therefore, the silver iodide-containing phase tends to be formed in the vicinity of the grain surface. Accordingly, when the silver bromide-containing phase and the silver iodide-containing phase are present in different positions within a grain, the silver bromide-containing phase is preferably formed in the more inner side than the silver iodide-containing phase. In such a case, another silver bromide-containing phase may be further provided in the more outer side than the silver iodide-containing phase present in the vicinity of the grain surface.

The silver bromide or silver iodide content necessary for bringing out the effects of the present invention, such as elevation of sensitivity or contrast, increases as the silver, bromide- or silver iodide-containing phase is formed in the more inner side of the grain and this may cause excessive decrease of the silver chloride content to impair the rapid processability. Therefore, in order to converge these functions of controlling the photographic activities on the portion near to the surface within the grain, the silver bromide-containing phase and the silver iodide-containing phase are preferably adjacent each other. For this purpose, it is preferred to form the silver bromide-containing phase at any position in the region from 50 to 100% of the grain volume as measured from the inner side and form the silver iodide-containing phase at any position in the region from 85 to 100% of the grain volume. It is more preferred to form the silver bromide-containing phase at any position in the region from 70 to 95% of the grain volume and form the silver iodide-containing phase at any position in the region from 90 to 100% of the grain volume.

The introduction of bromide or iodide ion for incorporating silver bromide or silver iodide into the silver halide emulsion of the present invention may be performed by adding a bromide or iodide salt solution alone or adding a bromide or iodide salt solution in combination with the addition of a silver salt solution and a high chloride salt solution. In the latter case, a bromide or iodide salt solution and a high chloride solution may be separately added or a mixed solution of a bromide or iodide salt and a high chloride salt may be added. The bromide or iodide salt is added in the form of a soluble salt such as alkali or alkaline earth bromide or iodide salt. As described in U.S. Pat. No. 5,389,508, the bromide or iodide ion may also be introduced by cleaving it from an organic molecule. Furthermore, a fine silver bromide or silver iodide grain may also be used as another bromide or iodide ion source.

The addition of the bromide or iodide salt solution may be performed intensively at one period during the grain formation or may be performed over a certain period of time. The site of the high chloride emulsion, to which the iodide ion is introduced, is limited for obtaining an emulsion having high sensitivity and low fog. As the iodide ion is introduced in the more inner side of the emulsion grain, the increase of sensitivity is smaller. Therefore, the iodide salt solution is preferably added from the more outer portion than 50%, more preferably 70%, and most preferably 85%, of the grain volume. Furthermore, the addition of the iodide salt solution is preferably completed in the more inner portion than 98%, more preferably 96%, of the grain volume. By completing the addition of the iodide salt solution at a slightly inner portion from the grain surface, an emulsion having higher sensitivity and lower fog can be obtained.

The bromide salt solution is preferably added from the more outer portion than 50%, more preferably 70%, of the grain volume.

The distribution of bromide or iodide ion concentration in the depth direction within a grain can be measured by the etching/TOF-SIMS (time of flight-secondary ion mass spectrometry) method, for example, by using Model TRIFT II TOF-SIMS manufactured by Phi Evans. The TOF-SIMS method is specifically described in *Hyomen Bunseki Gijutsu Sensho Niji Ion Shitsuryo Bunseki Ho* (*Surface Analysis Techniques Series, Secondary Ion Mass Spectrometry Method*), compiled by The Society of Surface Science of Japan, Maruzen (1999). When the emulsion grain is analyzed by the etching/TOF-SIMS method, it can be analyzed that even if the addition of the iodide salt solution is completed in the inner side of a grain, iodide ion is bleeding out to the grain surface. In the emulsion of the present invention, as analyzed by the etching/TOF-SIMS method, the iodide ion concentration preferably has a peak at the grain surface and decreases toward the inner side and the bromide ion concentration preferably has a peak inside the grain. When the silver bromide content is high to a certain degree, the local concentration of silver bromide can be measured also by the X-ray diffraction method.

In the present invention, the equivalent-sphere diameter is expressed by a diameter of a sphere having the same volume as the volume of each grain. The emulsion of the present invention preferably comprises grains having a monodisperse grain size distribution. In the present invention, the coefficient of variation in the equivalent-sphere diameter of all grains is preferably 20% or less, more preferably 15% or less, still more preferably 10% or less. The coefficient of variation in the equivalent-sphere diameter is expressed by a percentage of the standard deviation of equivalent-sphere diameters of individual grains to the average of equivalent-sphere diameters. At this time, blending of these monodisperse emulsions in the same layer or superposed coating of the emulsions is preferably performed so as to obtain a wide latitude.

In the case of applying the present invention to a silver halide color photographic light-sensitive material comprising at least one yellow dye-forming coupler-containing silver halide emulsion layer, at least one magenta dye-forming coupler-containing silver halide emulsion layer and at least one cyan dye-forming coupler-containing silver halide emulsion layer, the equivalent-sphere diameter of the silver halide emulsion for the yellow dye-forming coupler-containing silver halide emulsion layer is preferably 0.6 μm or less. The equivalent-sphere diameter of the silver halide emulsions for the magenta dye-forming coupler-containing silver halide emulsion layer and for the cyan dye-forming coupler-containing silver halide emulsion layer is preferably 0.5 μm or less, more preferably 0.4 μm or less. In the present invention, the equivalent-sphere diameter is expressed by a diameter of a sphere having the same volume as the volume of each grain. The grain having an equivalent-sphere diameter of 0.6 μm corresponds to a cubic grain having a side length of about 0.48 μm, the grain having an equivalent-sphere diameter of 0.5 μm corresponds to a cubic grain having a side length of about 0.40 μm, the grain having an equivalent-sphere diameter of 0.4 μm, corresponds to a cubic grain having a side length of about 0.32 μm, and the grain having an equivalent-sphere diameter of 0.3 μm corresponds to a cubic grain having a side length of about 0.24 μm. The silver halide emulsion of the present invention may contain a silver halide grain other than the silver halide grain contained in the silver halide emulsion defined in the present invention (namely, the specific silver halide grain). However, in the silver halide emulsion defined in the present invention, 50% or more of the projected area of all grains must be the silver halide grain defined in the present invention. The silver halide grain defined in the present invention preferably occupies 80% or more, more preferably 90% or more, of the projected area of all grains.

In addition to the iridium complex represented by formula (I), the specific silver halide grain in the silver halide emulsion of the present invention may further contain an iridium complex where 6 ligands all are Cl, Br or I. In this case, Cl, Br and I may be mixed in the hexacoordination complex. In particular, the iridium complex having Cl, Br or I as the ligand is preferably contained in the silver bromide-containing phase so as to obtain high-contrast gradation by high illuminance exposure.

Specific examples of the iridium complex where 6 ligands all are Cl, Br or I are set forth below, but this iridium complex is not limited thereto.

$[IrCl_6]^{2-}$
$[IrCl_6]^{3-}$
$[IrBr_6]^{2-}$
$[IrBr_6]^{3-}$
$[IrI_6]^{3-}$

These metal complexes have an average electron releasing time of 3 seconds or more.

In the present invention, a metal ion other than the above-described metal complexes may also be doped to the inside and/or surface of the silver halide grain. This metal ion is preferably a transition metal ion. In addition, this metal ion is more preferably used as a hexacoordination octahedral complex by being accompanied with a ligand. When an inorganic compound is used as the ligand, the ligand is preferably cyanide ion, halide ion, thiocyan, hydroxide ion, peroxide ion, azide ion, nitride ion, water, ammonia, nitrosyl ion or thionitrosyl ion. The ligand is preferably coordinated to a metal ion of iron, ruthenium, osmium, lead, cadmium or zinc. It is also preferred to use a plural kinds of ligands in one complex molecule. In the case of using an organic compound as the ligand, the organic compound is preferably a chained compound with the main chain having 5 or less carbon atoms and/or a 5- or 6-membered heterocyclic compound, more preferably a compound having within the molecule a nitrogen atom, a phosphorus atom, an oxygen atom or a sulfur atom as the coordination atom to the metal, still more preferably furan, thiophene, oxazole, isoxazole, thiazole, isothiazole, imidazole, pyrazole, triazole, furazane, pyran, pyridine, pyridazine, pyrimidine or pyrazine. Furthermore, compounds where the basic skeleton is the above-described compound and a substituent is introduced thereinto are also preferred.

The combination of a metal ion and a ligand is preferably a combination of an iron ion or a ruthenium ion with a cyanide ion. In the present invention, the above-described metal complex and this compound are preferably used in combination. In this compound, the cyanide ion preferably occupies the majority of the coordination number to iron or ruthenium as the center metal and the remaining coordination sites are preferably occupied by thiocyan, ammonia, water, nitrosyl ion, dimethyl sulfoxide, pyridine, pyrazine or 4,4'-bipyridine. Most preferably, six coordination sites of the center metal all are occupied by cyanide ion to form a hexacyanoiron complex or a hexacyano-ruthenium complex. This complex using cyanide ion as the ligand is preferably added in an amount of $1\times10^{-8}$ to $1\times10^{-2}$ mol, most preferably from $1\times10^{-6}$ to $5\times10^{-4}$ mol, per 1 mol of silver during the formation of grains.

The silver halide emulsion for use in the present invention is preferably subjected to gold sensitization known in the art. By subjecting the emulsion to gold sensitization, the sensitivity can be elevated and when scan-exposed by laser light or the like, the photographic performance can be made to less fluctuate. For the gold sensitization, various inorganic gold compounds, gold(I) complexes having an inorganic ligand, and gold(I) compounds having an organic ligand can be used. Examples of the inorganic gold compound which can be used include chloroauric acid and salts thereof, and examples of the gold(I) complex having an inorganic ligand, which can be used, include gold dithiocyanate compounds such as potassium gold(I) dithiocyanate, and gold dithiosulfate compounds such as trisodium gold(I) dithiosulfate.

Examples of the gold(I) compound having an organic ligand (organic compound), which can be used, include bis-gold(I) mesoionic heterocyclic rings described in JP-A-4-267249 such as bis(1,4,5-trimethyl-1,2,4-triazolium-3-thiolate)aurate(I) tetrafluoroborate, organic mercapto gold(I) complexes described in JP-A-11-218870 such as potassium bis(1-[3-(2-sulfonatobenzamido)phenyl)-5-mercaptotetrazole potassium salt)aurate(I) pentahydrate, and gold(I) compounds coordinated with a nitrogen compound anion described in JP-A-4-268550 such as bis(1-methyl-hydantoinate)gold(I) sodium salt tetrahydrate. This gold(I) compound having an organic ligand may be previously synthesized, isolated and used. Also, an organic ligand and an Au compound (for example, chloroauric acid or a salt thereof) may be mixed to generate the gold(I) compound having an organic ligand and added to the emulsion without isolating the compound, or an organic ligand and an Au compound (for example, chloroauric acid or a salt thereof) may be separately added to the emulsion to generate a gold(I) compound having an organic ligand in the emulsion.

In addition, gold(I) thiolate compounds described in U.S. Pat. No. 3,503,749, gold compounds described in JP-A-8-69074, JP-A-8-69075 and JF-A-9-269554, and compounds described in U.S. Pat. Nos. 5,620,841, 5,912,112, 5,620,841, 5,939,245 and 5,912,111 may also be used. The amount of this compound added varies over a wide range depending on the case but is usually from $5\times10^{-7}$ to $5\times10^{-3}$ mol, preferably from $5\times10^{-6}$ to $5\times10^{-4}$ mol, per mol of silver halide.

Furthermore, a colloidal gold sulfide may also be used and the production method thereof is described, for example, in *Research Disclosure,* 37154, *Solid State Ionics,* Vol. 79, pp. 60–66 (1995), and *Compt. Rend. Hebt. Seances Acad. Sci. Sect. B,* Vol. 263, page 1328 (1966). In *Research Disclosure,* supra, a method of using thiocyanate ion at the production of colloidal gold sulfide is described, but in place of the thiocyanate ion, a thioether compound such as methionine and thiodiethanol may also be used. The colloidal gold sulfide may have various sizes but the average particle size thereof is preferably 50 nm or less, more preferably 10 nm or less, still more preferably 3 nm or less. The particle size can be measured from TEM photograph. The colloidal gold sulfide may have a composition of $Au_2S_1$ or may have a composition with excess sulfur, such as $Au_2S_1$ to $Au_2S_2$. A composition with excess sulfur is preferred, and a composition of $AU_2S_{1.1}$ to $Au_2S_{1.8}$ is more preferred. The composition of the colloidal gold sulfide can be analyzed, for example, by taking out a gold sulfide particle and determining the gold content and the sulfur content according to an analysis method such as ICP and iodometry. If gold ion and sulfur ion (including hydrogen sulfide and salts thereof) dissolved in the liquid phase are present in the gold sulfide colloid, this affects the analysis of the composition of the gold sulfide particle. Therefore, the analysis of composition is performed after separating the gold sulfide particle by ultrafiltration or the like. The amount of gold sulfide colloid added varies over a wide range depending on the case but is usually, as the gold atom, from $5\times10^{-7}$ to $5\times10^{-3}$ mol, preferably from $5\times10^{-6}$ to $5\times10^{-4}$ mol, per mol of silver halide.

In combination with gold sensitization, chalcogen sensitization may be performed by the same molecule and a molecule capable of releasing $AuCh^-$ can be used, wherein Au represents Au(I) and Ch represents a sulfur atom, a selenium atom or a tellurium atom. Examples of the molecule capable of releasing $AuCh^-$ include gold compounds represented by AuCh-L, wherein L represents an atomic group of combining with AuCh to constitute the molecule. Also, Au may be coordinated with one or more ligand in addition to Ch-L. The gold compound represented by AuCh-L has a property such that when reacted in a solvent in the co-presence of silver ion, AgAuS when Ch is S, AgAuSe when Ch is Se, or AgAuTe when Ch is Te is readily produced. Examples of this compound, includes those where L is an acyl group. Other examples thereof include compounds represented by the following formulae (AuCh1), (AuCh2) and (AuCh3).

$R_1$—$X_1$—$M_1$-ChAu Formula (AuCh1)

wherein Au represents Au(I), Ch represents a sulfur atom, a selenium atom or a tellurium atom, $M_1$ represents a substituted or unsubstituted methylene group, $X_1$ represents an oxygen atom, a sulfur atom, a selenium atom or $NR_Z$, $R_1$ represents an atomic group of combining with $X_1$ to constitute the molecule (for example, an organic group such as alkyl group, aryl group and heterocyclic group), $R_2$ represents a hydrogen atom or a substituent (for example, an organic group such as alkyl group, aryl group and heterocyclic group), and $R_1$ and $M_1$ may combine with each other to form a ring.

In the compound represented by formula (AuCh1), Ch is preferably a sulfur atom or a selenium atom, $X_1$ is preferably an oxygen atom or a sulfur atom, and $R_1$ is preferably an alkyl group or an aryl group. Specific examples of the compound include Au(I) salts of thiosugar (e.g., thioglucose gold such as α-thioglucose gold, peracetylthioglucose gold, thiomannose gold, thiogalactose gold, thioarabinose gold), Au(I) salts of selenosugar (e.g., peracetylselenoglucose gold, peracetylselenomannose gold), and Au(I) salts of tellurosugar. Here, the thiosugar, selenosugar and tellurosugar means sugars where the hydroxyl group at the anomer position is replaced by an SH group, an SeH group or TeH group, respectively.

$W_1W_2C{=}CR_3ChAu$ Formula (AuCh2)

wherein Au represents Au(I), Ch represents a sulfur atom, a selenium atom or a tellurium atom, $M_3$ and $W_2$ each represents a substituent (for example, a hydrogen atom, a halogen atom or an organic group such as alkyl group, aryl group and heterocyclic group), $W_1$ represents an electron-withdrawing group having a positive Hammett's substituent constant σp value, and each of the pairs $R_3$ and $W_1$, $R_3$ and $W_2$, and $W_1$ and $W_2$ may combine with each other to form a ring.

In the compound represented by formula (AuCh2), Ch is preferably a sulfur atom or a selenium atom, $R_3$ is preferably a hydrogen atom or an alkyl group, and $W_1$ and $W_2$ each is preferably an electron-withdrawing group having a Hammett's substituent constant op value of 0.2 or more. Specific examples of the compound include $(NS)_2C{=}CHSAu$, $(CH_3OCO)_2C{=}CHSAu$ and $CH_3CO(CH_3OCO)C{=}CHSAu$.

$W_3$-E-ChAu Formula (AuCh3)

wherein Au represents Au(I), Ch represents a sulfur atom, a selenium atom or a tellurium atom, E represents a substituted or unsubstituted ethylene group, and $W_3$ represents an electron-withdrawing group having a positive Hammett's substituent constant σp value.

In the compound represented by formula (AuCh3), Ch is preferably a sulfur atom or a selenium atom, E is preferably an ethylene group containing an electron-withdrawing group having a positive Hammett's substituent constant σp value, and $W_3$ is preferably an electron-withdrawing group having a Hammett's substituent constant σp value of 0.2 or more. The amount of such a compound added varies over a wide range depending on the case, but is usually from $5\times10^{-7}$ to $5\times10^{-3}$ mol, preferably from $3\times10^{-6}$ to $3\times10^{-4}$ mol, per mol of silver halide.

In the present invention, the gold sensitization may further be combined with other sensitization methods such as sulfur sensitization, selenium sensitization, tellurium sensitization, reduction sensitization and noble metal sensitization using a noble metal except for gold compounds. Particularly, combination with sulfur sensitization and selenium sensitization is preferred.

In the silver halide emulsion of the present invention, various compounds or precursors thereof may be added for the purpose of preventing occurrence of fogging during production, storage or photographic processing of a light-sensitive material or for stabilizing photographic performances. Specific preferred examples of these compounds include those described in JP-A-62-215272, pp. 39–72. In addition, 5-arylamino-1,2,3,4-thiatriazole compounds (wherein the aryl residue has at least one electron-withdrawing group) described in European Patent 0447647 may also be preferably used.

For the purpose of enhancing the storability of the silver halide emulsion of the present invention, the following compounds are also preferably used in the present invention, that is, hydroxamic acid derivatives described in JP-A-11-109576, cyclic ketones having a double bond being adjacent to a carbonyl group and substituted with an amino group or a hydroxyl group at both ends described in JP-A-11-327094 (particularly, those represented by formula (S1); paragraphs 0036 to 0071 can be incorporated herein by reference), sulfo-substituted catechols or hydroquinones (for example, 4,5-dihydroxy-1,3-benzenedisulfonic acid, 2,5-dihydroxy-1,4-benzenedisulfonic acid, 3,4-dihydroxy-benzenesulfonic acid, 2,3-dihydroxybenzenesulfonic acid, 2,5-dihydroxybenzenesulfonic acid, 3,4,5-trihydroxybenzene-sulfonic acid, and salts thereof) described in JP-A-11-43011, hydroxylamines represented by formula (A) of U.S. Pat. No. 5,556,741 (those described in column 4, line 56 to column 11, line 22 of U.S. Pat. No. 5,556,741 are preferably used also in the present invention and these are incorporated herein by reference), and water-soluble reducing agents represented by formulae (I) to (III) of JP-A-11-102045.

For the purpose of imparting so-called spectral sensitivity, that is, for exhibiting light sensitivity in a desired light wavelength region, a spectral sensitizing dye may be contained in the silver halide emulsion of the present invention. Examples of spectral sensitizing dyes for imparting spectral sensitization in blue, green and red regions include those described in F. M. Harmer, *Heterocyclic Compounds—Cyanine Dyes and Related Compounds,* John Wiley & Sons [New York and London] (1964). As for the specific examples of compounds and the spectral sensitizing method, those described in JP-A-62-215272, supra, page 22, right upper column to page 38, are preferably used. In particular, as the red-sensitive spectral sensitizing dye for silver halide emulsion grains having a high silver chloride content, spectral sensitizing dyes described in JP-A-3-123340 are very preferred in view of stability, adsorption strength, temperature dependency of exposure, and the like.

The amount of the spectral sensitizing dye added varies over a wide range depending on the case, but is preferably from $0.5\times10^{-6}$ to $1.0\times10^{-2}$ mol, more preferably from $1.0\times10^{-6}$ to $5.0\times10^{-3}$ mol, per mol of silver halide.

The silver halide color photographic light-sensitive material (hereinafter, sometimes simply referred to as a "light-sensitive material") of the present invention is characterized in that in a silver halide color photographic light-sensitive material comprising a support having thereon at least one yellow dye-forming coupler-containing silver halide emulsion layer, at least one magenta dye-forming coupler-containing silver halide emulsion layer and at least one cyan dye-forming coupler-containing silver halide emulsion layer, at least one of these silver halide emulsion layers contains the silver halide emulsion of the present invention. In the present invention, the yellow dye-forming coupler-containing silver halide emulsion functions as a yellow color-forming layer, the magenta dye-forming coupler containing silver halide emulsion layer functions as a magenta color-forming layer, and the cyan dye-forming coupler-containing silver halide emulsion layer functions as a cyan color-forming layer. The silver halide emulsions contained in these yellow color-forming layer, magenta color-forming layer and cyan color-forming layer are preferably sensitive to light in different wavelength regions from each other (for example, light in the blue color region, light in the green color region and light in the red color region).

If desired, the light-sensitive material of the present invention may contain a hydrophilic colloid layer, an anti-halation layer, an interlayer and a colored layer, which are described later, in addition to those yellow color-forming layer, magenta color-forming layer and cyan color-forming layer.

In the light-sensitive material of the present invention, conventionally known photographic materials and additives may be used.

For example, the photographic support which can be used includes a transmissive support and a reflective support. The transmissive support is preferably a transparent film such as cellulose nitrate film and polyethylene terephthalate, or a polyester such as polyester of 2,6-naphthalenedicarboxylic acid (NDCA) and ethylene glycol (EG) and polyester of NDCA, terephthalic acid and EG, on which polyester an information recording layer such as magnetic layer is provided. The reflective support is preferably a reflective support where a plurality of polyethylene or polyester layers are laminated and at least one of these water-resistant resin layers (laminated layers) contains a white pigment such as titanium oxide.

The reflective support for use in the present invention is more preferably a reflective support obtained by providing a polyolefin layer having fine holes on a paper substrate in the side where a silver halide emulsion layer is provided. The polyolefin layer may comprise multiple layers and in this case, it is preferred that the polyolefin layer (e.g., polypropylene, polyethylene) adjacent to the gelatin layer in the silver halide emulsion layer side has no fine hole and the polyolefin layer (e.g., polypropylene, polyethylene) in the side closer to the paper substrate has fine holes. The density of the polyolefin layer having a multilayer structure or a single layer structure interposed between the paper substrate and a photographic constituent layer is preferably from 0.40 to 1.0 g/ml, more preferably from 0.50 to 0.70 g/ml. The thickness of the polyolefin layer having a multilayer structure or a single layer structure interposed between the paper substrate and a photographic constituent layer is preferably from 10 to 100 μm, more preferably from 15 to 70 μm. The ratio in the thickness of the polyolefin layer to the paper substrate is preferably from 0.05 to 0.2, more preferably from 0.1 to 0.15.

From the standpoint of enhancing the rigidity of the reflective support, it is also preferred to provide a polyolefin layer on the surface opposite the photographic constituent layer (back surface) of the paper substrate. In this case, the polyolefin layer on the back surface is preferably a polyethylene or polypropylene layer having a matted surface, more preferably a polypropylene layer. The thickness of the polyolefin layer on the back surface is preferably from 5 to 50 μm, more preferably from 10 to 30 μm, and the density thereof is preferably from 0.7 to 1.1 g/ml. Examples of the preferred embodiment of the polyolefin layer provided on the paper substrate of the reflective support for use in the present invention include those described in JP-A-10-333277, JP-A-10-333278, JP-A-11-52513, JP-A-11-65024 and European Patents 0880065 and 0880066.

The above-described water-resistant resin layer preferably contains a fluorescent brightening agent. A hydrophilic colloid layer having dispersed therein the fluorescent brightening agent may be separately formed. The florescent brightening agent which can be used is preferably a florescent brightening agent of benzoxazole type, coumarin type or pyrazoline type, more preferably a florescent brightening agent of benzoxazolyl naphthalene type or benzoxazolyl stilbene type. The amount used thereof is not particularly limited but is preferably from 1 to 100 mg/m$^2$. In the case of mixing the fluorescent brightening agent with the water-resistant resin, the mixing ratio to the resin is preferably from 0.0005 to 3% by mass, more preferably from 0.001 to 0.5% by mass.

The reflective support may also be a support obtained by providing a hydrophilic colloid layer containing a white pigment on a transmissive support or on the above-described reflective support. The reflective support may have a metal surface with mirror reflection or secondary diffuse reflection.

The support for use in the light-sensitive material of the present invention may also be a white polyester-base support for display or a support after a layer containing a white pigment is provided on the support in the side having a silver halide emulsion layer. Furthermore, in order to improve the sharpness, an antihalation layer is preferably provided on the support in the side where a silver halide emulsion layer is coated or on the back surface thereof. The support is preferably set to have a transmission density of 0.35 to 0.8 so that the display can be viewed with either reflected light or transmitted light.

For the purpose of enhancing the sharpness or the like of an image, it is preferred to add a dye capable of decoloration upon processing (particularly, oxonol-base dye) described in EP-A-0337490, pp. 27–76, to a hydrophilic colloid layer of the light-sensitive material of the present invention such that the light-sensitive material has an optical reflection density of 0.70 or more at 680 nm, or to incorporate 12% by mass or more (more preferably 14% by mass or more) of titanium oxide surface-treated with a di-, tri- or tetra-hydric alcohol (e.g., trimethylolethane), into the water-resistant resin layer of the support.

In the light-sensitive material of the present invention, a dye capable of decoloration upon processing (particularly, oxonol dye or cyanine dye) described in EP-A-0337490, pp. 27–76, is preferably added to a hydrophilic colloid layer so as to prevent irradiation or halation or enhance the safelight immunity or the like. In addition, the dyes described in European Patent 0819977 may also be preferably used in the present invention. Some of these water-soluble dyes deteriorate the color separation or safelight immunity when the amount used thereof is increased. As for the dye which can be used without deteriorating the color separation, the water-soluble dyes described in JP-A-5-127324, JP-A-5-127325 and JP-A-5-216185 are preferred.

In the present invention, a colored layer capable of decoloration upon processing is used in place of or in combination with the water-soluble dye. The colored layer capable of decoloration upon processing may be directly contacted with an emulsion layer or may be disposed to contact with an emulsion layer through an interlayer containing a process color mixing inhibitor such as gelatin or hydroquinone. This colored layer is preferably provided as an underlayer (in the support side) of an emulsion layer which forms the same primary color as the color of the colored layer. All colored layers corresponding to respective primary colors may be individually provided or only a part thereof may be freely selected and provided. Also, a colored layer subjected to formation of colors corresponding to a plurality of primary color regions may also be provided. The optical reflection density of the colored layer is preferably such that the optical density value at a wavelength having a highest optical density in the wavelength region used for exposure (in a normal printer exposure, a visible light region of 400 to 700 nm and in the case of scanning exposure, the wavelength of the light source used for the scanning exposure) is from 0.2 to 3.0, more preferably from 0.5 to 2.5, still more preferably from 0.8 to 2.0.

The colored layer may be formed by a conventionally known method. Examples of the method include a method of incorporating a dye described in JP-A-2-282244, page 3, right upper column to page 8, or a dye described in JP-A-3-7931, page 3, right upper column to page 11, left lower column, which is in the form of a solid fine particle dispersion, into a hydrophilic colloid layer, a method of mordanting an anionic dye to a cationic polymer, a method of allowing a dye to adsorb to a fine particle such as silver halide and thereby fixing the dye in a layer, and a method of using colloidal silver described in JP-A-1-239544. With respect to the method for dispersing fine powder of a dye in the solid state, a method of incorporating a fine powder dye which is substantially water-insoluble at least at a pH of 6 or less but substantially water-soluble at least at a pH of 8 or more is described, for example, in JP-A-2-308244, pp. 4–13. The method of mordanting an anionic dye to a cationic polymer is described, for example, in JP-A-2-84637, pp. 18–26. Also, the preparation method of colloidal silver as a light absorbent is disclosed in U.S. Pat. Nos. 2,688,601 and 3,459,563. Among these methods, the method of incorporating a fine powder dye and the method of using colloidal silver are preferred.

The silver halide color photographic light-sensitive material of the present invention can be used for color negative film, color positive film, color reversal film, color reversal printing paper, color printing paper and the like but is preferably used as color printing paper. The color printing paper preferably comprises at least one yellow color-forming silver halide emulsion layer, at least one magenta color-forming silver halide emulsion layer and at least one cyan color-forming silver halide emulsion layer. In general, these silver halide emulsion layers are provided in the order of, from the side closer to the support, a yellow color-forming silver halide emulsion layer, a magenta color-forming silver halide emulsion layer and a cyan color-forming silver halide emulsion layer.

However, a layer structure different from the above may also be employed.

The silver halide emulsion layer containing a yellow coupler may be disposed at any position on the support but when the yellow coupler-containing layer comprises silver halide tabular grains, the layer is preferably provided at the position more distant from the support than at least one of the magenta coupler-containing silver halide emulsion layer and the cyan coupler-containing silver halide emulsion layer. From the standpoint of accelerating the color development or desilvering and reducing the residual color due to sensitizing dyes, the yellow coupler-containing silver halide emulsion layer is preferably provided at the position most distant from the support than other silver halide emulsion layers. In view of the reduction in the blix (bleach-fixing) discoloration, the cyan coupler-containing silver halide emulsion is preferably provided as a midmost layer of other silver halide emulsion layers and in view of the reduction in the light discoloration, the cyan coupler-containing silver halide emulsion layer is preferably provided as a lowermost layer. The yellow, magenta and cyan color-forming layers each may be composed of two or three layers. It is also preferred to provide a coupler layer containing no silver halide emulsion adjacently to a silver halide emulsion layer to form a color-forming layer as described, for example, in JP-A-4-75055, JP-A-9-114035, JP-A-10-246940 and U.S. Pat. No. 5,576,159.

As for the silver halide emulsion, other materials (for example, additives) and photographic constituent layers (for example, layer arrangement), which are applied to the present invention, and the processing method and additives for the processing, which are applied to the processing of the light-sensitive material, those described in JP-A-62-215272, JP-A-2-33144 and EP-A-0355660, particularly those described in EP-A-0355660, are preferably used. In addition, the silver halide color photographic light-sensitive materials and the processing methods therefor described in JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641 and EP-A-0520457 may also be preferably used.

Particularly, as for the reflective support, silver halide emulsion, foreign metal ion species doped in a silver halide grain, storage stabilizer and antifoggant for silver halide emulsion, chemical sensitization method (including sensitizer), spectral sensitization method (including spectral sensitizer), cyan, magenta and yellow couplers and emulsion-dispersion method therefor, dye image preservability improver (for example, staining inhibitor and discoloration inhibitor), dye (colored layer), gelatin species, layer structure of light-sensitive material and coating pH of light-sensitive material, those described in patents shown in Table 1 below may be preferably applied to the present invention.

TABLE 1

| Element | JP-A-7-104448 | JP-A-7-77775 | JP-A-7-301895 |
|---|---|---|---|
| Reflective support | column 7, line 12 to column 12, line 19 | column 35, line 43 to column 44, line 1 | column 5, line 40 to column 9, line 26 |
| Silver halide emulsion | column 72, line 29 to column 74, line 18 | column 44, line 36 to column 46, line 29 | column 77, line 48 to column 80, line 28 |
| Foreign metal ion species | column 74, lines 19 to 44 | column 46, line 30 to column 47, line 5 | column 80, line 29 to column 81, line 6 |
| Storage stabilizer and antifoggant | column 75, lines 9 to 18 | column 47, lines 20 to 29 | column 18, line 11 to column 31, line 37 (particularly, mercapto-heterocyclic compounds) |
| Chemical sensitization method (chemical sensitizer) | column 74, line 45 to column 75, line 6 | column 47, lines 7 to 17 | column 81, lines 9 to 17 |
| Spectral sensitization method (spectral sensitizer) | column 75, line 19 to column 76, line 45 | column 47, line 30 to column 49, line 6 | column 81, line 21 to column 82, line 48 |
| Cyan coupler | column 12, line 20 to column 39, line 49 | column 62, line 50 to column 63, line 16 | column 88, line 49 to column 89, line 16 |
| Yellow coupler | column 87, line 40 to column 88, line 3 | column 63, lines 17 to 30 | column 89, lines 17 to 30 |
| Magenta coupler | column 88, lines 4 to 18 | column 63, line 3 to column 64, line 11 | column 31, line 34 to column 77, line 44 and column 88, lines 32 to 46 |
| Emulsion-dispersion method of coupler | column 71, line 3 to column 72, line 11 | Column 61, lines 36 to 49 | column 87, lines 35 to 48 |
| Dye image storability improver (staining inhibitor) | column 39, line 50 to column 70, line 9 | Column 61, line 50 to column 62, line 49 | column 87, line 49 to column 88, line 48 |
| Discoloration inhibitor | column 70, line 10 to column 71, line 2 | | |
| Dye (colorant) | column 77, line 42 to column 78, line 41 | Column 7, line 14 to column 19, line 42 and column 50, line 3 to column 51, line 14 | column 9, line 27 to column 18, line 10 |
| Gelatin species | column 78, lines 42 to 48 | Column 51, lines 15 to 20 | column 83, lines 13 to 19 |
| Layer structure of light-sensitive material | column 39, lines 11 to 26 | Column 44, lines 2 to 35 | column 31, line 38 to column 32, line 33 |
| Coating pH of light-sensitive material | column 72, lines 12 to 28 | | |
| Scanning exposure | column 76, line 6 to column 77, line 41 | Column 49, line 7 to column 50, line 2 | column 82, line 49 to column 83, line 12 |
| Preservative in developer | column 88, line 19 to column 89, line 22 | | |

In addition, the couplers described in JP-A-62-215272, from page 91, right upper column, line 4 to page 121, left upper column, line 6, JP-A-2-33144, from page 3, right upper column, line 14 to page 18, left upper column, last line and from page 30, right upper column, line 6 to page 35, right lower column, line 11, and EP-A-0355660, page 4, lines 15 to 27, from page 5, line 30 to page 28, last line, page 45, lines 29 to 31, and from page 47, line 23 to page 63, line 50 are also useful as the cyan, magenta and yellow couplers for use in the present invention.

Furthermore, the compounds represented by formulae (II) and (III) of International Publication WO98/33760 and formula (D) of JP-A-10-221825 may also be preferably used in the present invention.

The cyan dye-forming coupler (sometimes simply referred to as a "cyan coupler") which can be used in the present invention is preferably a pyrrolotriazole-base coupler and preferred examples thereof include the couplers represented by formulae (I) and (II) of JP-A-5-313324, the couplers represented by formula (I) of JP-A-6-347960 and exemplary couplers described in these patents. Also, phenol-base and naphthol-base cyan couplers are preferably used and preferred examples thereof include the cyan couplers represented by formula (ADF) of JP-A-10-333297. Other preferred examples of the cyan coupler include pyrroloazole-type cyan couplers described in European Patent 0488248 and EP-A-0491197, 2,5-diacylaminophenol couplers described in U.S. Pat. No. 5,888,716, pyrazoloazole-type cyan couplers having an electron-withdrawing group or a hydrogen bond group at the 6-position described in U.S. Pat. Nos. 4,873,183 and 4,916,051, and particularly pyrazoloazole-type cyan couplers having a carbamoyl group at the 6-position described in JP-A-8-171185, JP-A-8-311360 and JP-A-8-339060.

In addition, diphenylimidazole-base cyan couplers described in JP-A-2-33144, 3-hydroxypyridine-base cyan couplers described in EP-A-0333185 (in particular, Coupler (42) as a 4-equivalent coupler allowed to have a chlorine splitting-off group and converted into a 2-equivalent coupler, and Couplers (6) and (9) are preferred), cyclic active methylene-base cyan couplers described in JP-A-64-32260 (in particular, Couplers 3, 8 and 34 are preferred), pyrrolopyrazole-type cyan couplers described in EP-A-0456226, and pyrroloimidazole-type cyan couplers described in European Patent 0484909 may also be used.

Among these cyan couplers, pyrroloazole-base cyan couplers represented by formula (I) of JP-A-11-282138 are particularly preferred and the description in paragraphs 0012 to 0059 of this patent publication including Cyan Couplers (1) to (47) is applied as it is to the present invention and preferably incorporated as a part of the present application.

The magenta dye-forming coupler (sometimes simply referred to as a "magenta coupler") for use in the present invention may be a 5-pyrazolone-base magenta coupler or a pyrazoloazole-base magenta coupler described in known publications shown in the Table above. Among these, preferred in view of color hue, image stability and color formability are pyrazolotriazole couplers described in JP-A-61-65245, in which a secondary or tertiary alkyl group is directly bonded to the 2-, 3- or 6-position of the pyrazolotriazole ring; pyrazoloazole couplers containing a sulfonamide group within the molecule described in JP-A-61-65246; pyrazoloazole couplers having an alkoxyphenylsulfamide ballast group described in JP-A-61-147254; and pyrazoloazole couplers having an alkoxy group or an aryloxy group at the 6-position described in EP-A-226849 and EP-A-294785. In particular, the magenta coupler is preferably a pyrazoloazole coupler represented by formula (M-I) of JP-A-8-122984 and the description in the paragraphs 0009 to 0026 of this patent publication is applied as it is to the present invention and incorporated as a part of the present specification. In addition, pyrazoloazole couplers having a steric hindrance group at both the 3-position and the 6-position described in European Patents 854384 and 884640 are also preferably used.

Examples of the yellow dye-forming coupler (sometimes simply referred to as a "yellow coupler") which can be preferably used include, in addition to the compounds shown in the Table above, acylacetamide-type yellow couplers having a 3- to 5-membered ring structure at the acyl group described in EP-A-0447969; malondianilide-type yellow coupler having a cyclic structure described in EP-A-0482552; pyrrol-2 or 3-yl- or indol-2- or 3-yl-carbonylacetic acid anilide-base couplers described in EP-A-953870, EP-A-953871, EP-A-953872, EP-A-953873, EP-A-953874 and EP-A-953875; and acylacetamide-type yellow couplers having a dioxane structure described in U.S. Pat. No. 5,118,599. Among these, more preferred are acylacetamide-type yellow couplers where the acyl group is 1-alkylcyclopropane-1-carbonyl group, and malondianilide-type yellow couplers where one of the anilides constitutes an indoline ring. These couplers can be used individually or in combination.

The coupler for use in the present invention is preferably emulsion-dispersed in an aqueous solution of hydrophilic colloid after impregnating the coupler in a loadable latex polymer (for example, the polymer described in U.S. Pat. No. 4,203,716) in the presence (or absence) of a high-boiling point organic solvent shown in the Table above or after dissolving the coupler together with a water-insoluble and organic solvent-soluble polymer. Examples of the water-insoluble and organic solvent-soluble polymer which can be preferably used include homopolymers and copolymers described in U.S. Pat. No. 4,857,449, columns 7 to 15, and International Patent Publication WO88/00723, pages 12 to 30. In view of the dye image stability or the like, methacrylate-base and acrylamide-base polymers are preferred, and an acrylamide-base polymer is more preferred.

In the present invention, known color mixing inhibitors can be used and among these, those described in the following patents are preferred. Examples of the color mixing inhibitor which can be used include high molecular weight redox compounds described in JP-A-5-333501, phenidone or hydrazine-based compounds described in WO98/33760 and U.S. Pat. No. 4,923,787, and white couplers described in JP-A-5-249637, JP-A-10-282615 and German Patent 19629142A1, In the case of elevating the pH of the developer and thereby expediting the development, the redox compounds described in German Patent 19618786A1, EP-A-839623, EP-A-842975, German Patent 19806846A1 and French Patent 2760460A1 are preferably used.

In the present invention, a compound containing a triazine skeleton having a high molar absorption coefficient is preferably used as an ultraviolet absorbent and for example, the compounds described in the following patents can be used. This compound is preferably added to a light-sensitive layer and/or a light-insensitive layer. For example, the compounds described in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent 19739797A, EP-A-711804 and JP-T-8-501291 (the term "JP-T" as used herein means a "published Japanese translation of a PCT patent application") can be used.

Although gelatin is advantageously used as the binder or protective colloid for use in the light-sensitive material of the present invention, other hydrophilic colloid can be used alone or in combination with gelatin. In a preferred gelatin, the content of heavy metal impurities such as iron, copper, zinc and manganese is preferably 5 ppm or less, more preferably 3 ppm or less. The amount of calcium contained in the light-sensitive material is preferably 20 mg/m$^2$ or less, more preferably 10 mg/m$^2$ or less, and most preferably 5 mg/m$^2$ or less.

In the present invention, bactericide/antifungal described in JP-A-63-271247 are preferably added so as to prevent various molds and bacteria from proliferating in a hydrophilic colloid layer and thereby deteriorating the image. The coating pH of the light-sensitive material is preferably from 4.0 to 7.0, more preferably from 4.0 to 6.5.

In the present invention, the total coated gelatin amount in the photographic constituent layers is preferably from 3 to 6 g/m$^2$, more preferably from 3 to 5 g/m$^2$. Also, the entire thickness of photographic constituent layers is preferably from 3 to 7.5 μm, more preferably from 3 to 6.5 μm, so that the progress of development, fix-bleaching property and residual color can be satisfied even in an ultra-rapid processing. The dry film thickness can be measured and evaluated by observing the change in the film thickness before and after the peeling of dry film or the cross section through an optical microscope or an electron microscope. In the present invention, for increasing both the progress of development and the drying speed, the swelled film thickness is preferably from 8 to 19 μm, more preferably from 9 to 18 μm. The swelled film thickness can be determined by dipping and swelling the dry light-sensitive material in an aqueous solution at 35° C. and when the equilibrium reaches a satisfactory level, measuring the thickness according to a chopper bar method.

In the present invention, as the coated silver amount is smaller, the effect of the present invention is higher. The total coated silver amount in the yellow dye-forming coupler-containing silver halide emulsion layer, the magenta dye-forming coupler-containing silver halide emulsion layer and the cyan the dye-forming coupler-containing silver halide emulsion layer is preferably from 0.25 to 0.46 g/m$^2$, more preferably from 0.3 to 0.4 g/m$^2$. The coated silver amount in each of the yellow,dye-forming coupler-containing silver halide emulsion layer, the magenta dye-forming coupler-containing silver halide emulsion layer and the cyan the dye-forming coupler-containing silver halide emulsion layer is preferably from 0.07 to 0.2 g/m$^2$, more preferably from 0.08 to 0.18 g/m$^2$. In particular, the coated silver amount in the yellow dye-forming coupler-containing silver halide emulsion layer is most preferably from 0.07 to 0.15 g/m$^2$.

In the present invention, from the standpoint of, for example, improving the coating stability of the light-sensitive material, preventing the generation of electro-static charge and controlling the amount of electrostatic charge, a surfactant may be added to the light-sensitive material. The surfactant includes an anionic surfactant, a cationic surfactant, a betaine surfactant and a nonionic surfactant and examples thereof include those described in JP-A-5-333492. The surfactant for use in the present invention is preferably a surfactant containing a fluorine atom. In particular, a fluorine atom-containing surfactant can be preferably used. This fluorine atom-containing surfactant may be used alone or in combination with another conventionally known surfactant but is preferably used in combination with another conventionally known surfactant. The amount of the surfactant added to the light-sensitive material is not particularly limited but is generally from $1\times10^{-5}$ to 1 g/m$^2$, preferably from $1\times10^{-4}$ to $1\times10^{-1}$ g/m$^2$, more preferably from $1\times10^{-3}$ to $1\times10^{-2}$ g/m$^2$.

The light-sensitive material of the present invention can form an image through an exposure step of irradiating light according to the image information and a development step of developing the light-sensitive material irradiated with light. The light-sensitive material of the present invention is used for a printing system using a normal negative printer and additionally, is suitably used for a scanning exposure system using a cathode ray tube (CRT). The cathode ray tube exposure device is simple and compact as compared with other devices using a laser and therefore, this device costs low. Also, the optical axis and colors can be easily adjusted. For the cathode ray tube used in the image exposure, various light emitters capable of emitting light in the required spectral region are used. For example, a red light emitter, a green light emitter and a blue light emitter are used individually or in combination of two or more thereof. The spectral region is not limited to these red, green and blue regions but an emitter capable of emitting light in the yellow, orange, ultraviolet or infrared region may also be used. In particular, a cathode ray tube using a mixture of these light emitters to emit white light is often used.

In the case where the light-sensitive material has a plurality of light-sensitive layers differing in the spectral sensitivity distribution and the cathode ray tube also has emitters of emitting light in a plurality of spectral regions, multiple colors may be exposed at a time, namely, the light may be emitted from the tube surface after image signals of multiple colors are input to the cathode ray tube. A method of sequentially inputting the image signals every each color, sequentially emitting light of respective colors, and performing the exposure through a film which cuts colors other than those colors (surface sequential exposure) may also be employed. In general, the surface sequential exposure is advantageous for attaining high image quality because a high resolution cathode ray tube can be used.

The light-sensitive material of the present invention is preferably used for digital scanning exposure system using monochromatic high-density light such as gas laser, light-emitting diode, semiconductor laser or second harmonic generating light source (SHG) comprising a combination of a nonlinear optical crystal with a semiconductor laser or a solid state laser using a semiconductor laser as an excitation light source. In order to make the system compact and inexpensive, a semiconductor laser or a second harmonic generating light source (SHG) comprising a combination of a nonlinear optical crystal with a semiconductor laser or a solid state laser is preferably used. Particularly, in order to design a compact and inexpensive device having a long life and high stability, a semiconductor laser is preferably used and at least one of exposure light sources is preferably a semiconductor laser.

In the case of using this scanning exposure light source, the spectral sensitivity maximum wavelength of the light-sensitive material of the present invention can be freely set according to the wavelength of the scanning exposure light source used. In the case of an SHG light source obtained by combining a nonlinear optical crystal with a semiconductor laser or a solid state laser using a semiconductor laser as an excitation light source, the oscillation wavelength of the laser can be halved and therefore, blue light and green light are obtained. Accordingly, the light-sensitive material can be made to have a spectral sensitivity maximum in normal three wavelength regions of blue, green and red. The exposure time in the scanning exposure is, when this is defined as the time for exposing a picture element size with a picture element density of 400 dpi, preferably $10^{-4}$ seconds or less, more preferably $10^{-6}$ seconds or less.

In the case of applying the present invention to a silver halide color photographic light-sensitive material, the light-sensitive material is preferably imagewise exposed with coherent light of a blue laser having an emission wavelength of 420 to 460 nm. Among blue lasers, a blue semiconductor laser is preferred specific examples of the laser light source which can be preferably used include a blue semiconductor laser having a wavelength of 430 to 450 nm (published by Nichia Kagaku at 48th Associated Lecture Presentation Relating to Applied Physics (March 2001)), a blue laser of about 470 nm taken out by converting the wavelength of a semiconductor laser (oscillation wavelength: about 940 nm) with an SHG crystal of $LiNbO_3$ having a waveguide path-like inverted domain structure, a green laser of about 530 nm taken out by converting the wavelength of a semiconductor laser (oscillation wavelength: about 1,060 nm) with an SHG crystal of $LiNbO_3$ having a waveguide path-like inverted domain structure, a red semiconductor laser having a wavelength of about 685 nm (Hitachi Type No. HL6738MG) and a red semiconductor laser having a wavelength of about 650 nm (Hitachi Type No. HL6501MG).

The silver halide color photographic light-sensitive material of the present invention is preferably used in combination with the exposure and development system described in the following publications. Examples of the development system include an automatic printing and developing system described in JP-A-10-333253, a light-sensitive material conveying device described in JP-A-2000-10206, a recording system containing an image-reading device described in JP-A-11-215312, an exposure system comprising a color image recording unit described in JP-A-11-88619 and JP-A-10-202950, a digital photo-print system containing a remote diagnosis unit described in JP-A-10-210206, and a photo-print system containing an image recording device described in Japanese Patent Application No. 10-159187.

The preferred scanning exposure system which can be applied to the present invention is described in detail in the patents shown in the Table above.

In exposing the light-sensitive material of the present invention in a printer, a band stop filter described in U.S. Pat. No. 4,880,726 is preferably used, whereby light color mixing can be eliminated and color reproducibility can be greatly improved. In the present invention, copy restriction may be applied by pre-exposing a yellow microdot pattern in advance of imparting the image information as described in EP-A-0789270 and EF-A-0789480.

In processing the light-sensitive material of the present invention, the processing materials and processing methods described in JP-A-2-207250, from page 26, right lower column, line 1 to page 34, right upper column, line 9, and in JP-A-4-97355, from page 5, left upper column, line 17 to page 18, right lower column, line 20, may be preferably applied. For the preservative used in this developer, the compounds described in the patents shown in the Table above may be preferably used.

The present invention is used as a light-sensitive material having suitability for rapid processing. The color development time is 28 seconds or less, preferably from 6 to 25 seconds, more preferably from 6 to 20 seconds. Similarly, the bleach-fixing time is preferably 30 seconds or less, more preferably from 6 to 25 seconds, still more preferably from 6 to 20 seconds. The water washing or stabilization time is preferably 60 seconds or less, more preferably from 6 to 40 seconds. The color development time means a time period from a light-sensitive material enters in a color developer until it enters in a bleach-fixing solution in the subsequent processing step. For example, in the case of processing the light-sensitive material in an automatic developing machine, the sum total of two time periods, namely, the time period where the light-sensitive material is immersed in a color developer (so-called in-liquid time) and the time period where the light-sensitive material departs from the color developer and is transferred in air toward the bleach-fixing bath in the subsequent step (so-called in-air time), is called a color development time. In the same way, the bleach-fixing time means the time period from the light-sensitive material enters in a bleach-fixing solution until it enters in the subsequent water washing or stabilizing bath. Also, the water washing or stabilization time means a time period where the light-sensitive material enters in the water washing or stabilizing solution and stays in the solution (so-called in-liquid time) in preparation for the drying step.

The silver halide color photographic light-sensitive material of the present invention is further characterized in that when the silver halide color photographic light-sensitive material is exposed with light at a wavelength to which the silver halide emulsion layer containing the silver halide emulsion of the present invention is sensitive and then subjected to color development, the obtained reflection density satisfies the relationship in the following formula:

$$DS_{0.1}-DS_{0.0001}\leqq 0.3$$

wherein $DS_{0.1}$ represents a reflection density at an exposure amount, in terms of illuminance, 0.5 logE larger than the exposure amount necessary for obtaining a reflection density of 0.7 when exposed for 0.1 second with light at a wavelength to which the silver halide emulsion layer is sensitive and then subjected to color development, and $DS_{0.0001}$ represents a reflection density at an exposure amount, in terms of illuminance, 0.5 logE larger than the exposure amount necessary for obtaining a reflection density of 0.7 when exposed for 0.0001 second with light at a wavelength to which the silver halide emulsion layer is sensitive and then subjected to color development.

The value of $DS_{0.1}-DS_{0.0001}$ is a difference of the reflection densities between exposure for 0.1 second and exposure for 0.0001 second at respective exposure amounts, in terms of illuminance, 0.5 logE larger than the registered point when the gradation obtained by 0.1-second exposure and the gradation obtained by 0.0001-second exposure are superposed while registering at a reflection density of 0.7. This value represents substantially a difference in the gradation at the shoulder part. When the value of $DS_{0.1}-DS_{0.0001}$ is positive, the 0.0001-second exposure is lower in the contrast at the shoulder part than the 0.1-second exposure, and when the value is negative, the 0.0001-second exposure is higher in the contrast at the shoulder part than the 0.1-second exposure.

The value of $DS_{0.1}-DS_{0.0001}$ preferably satisfies the relationship in the following formula:

$$DS_{0.1}-DS_{0.0001}\leqq 0.15$$

It is more preferred that $DS_{0.1}-DS_{0.0001}$ takes a negative value and satisfies the relationship in the following formula:

$$DS_{0.1}-DS_{0.0001}\leqq 0.$$

In these formulae, the lower limit of $DS_{0.1}-DS_{0.0001}$ is not particularly limited but is preferably −0.3 or more.

Furthermore, when the light-sensitive material is exposed for 0.000001 second with light at a wavelength to which the silver halide emulsion layer is sensitive and then subjected to color development and when $DS_{0.000001}$ is assumed as a reflection density at an exposure amount, in terms of illuminance, 0.5 logE larger than the exposure amount necessary for obtaining a reflection density of 0.7 in the corresponding color-formed layer, the reflection density preferably satisfies:

$$DS_{0.1}-DS_{0.000001}\leqq 0.3$$

because the contrast less lowers even at high illuminance exposure.

The value of $DS_{0.1}-DS_{0.000001}$ more preferably satisfies the relationship in the following formula:

$$DS_{0.1}-DS_{0.000001}\leqq 0.15.$$

It is still more preferred that $DS_{0.1}-DS_{0.000001}$ takes a negative value and satisfies the relationship in the following formula:

$$DS_{0.1}-DS_{0.000001}\leqq 0.$$

The present invention is described in greater detail by referring to Examples, however, the present invention is not limited thereto.

EXAMPLE 1

(Preparation of Emulsion B-H)

A cubic high silver chloride emulsion having an equivalent-sphere diameter of 0.55 μm and a variation coefficient of 10% was prepared by an ordinary method of simultaneously adding and mixing silver nitrate and sodium chloride in an aqueous gelatin solution under stirring. However, between the time when 80% of silver nitrate was added and the time when 90% of silver nitrate was added, potassium bromide (3 mol % per mol of finished silver halide) and $K_4[Ru(CN)_6]$ were added. Also, between the time when 83% of silver nitrate was added and the time when 88% of silver nitrate was added, $K_2[IrCl_6]$ was added, and at the time when 90% of silver nitrate was added, potassium iodide (0.3 mol % per mol of finished silver halide) was added The obtained emulsion was desalted and after adding gelatin, re-dispersed. Thereafter, sodium benzenethio-sulfonate, Sensitizing Dye A and Sensitizing Dye B were added thereto and the resulting emulsion was optimally ripened by using thioglucose gold as the sensitizer. Thereto, 1-phenyl-5-mercaptotetrazole and 1-(5-methyl-ureidophenyl)-5-mercaptotetrazole were further added. The thus-obtained emulsion was designated as Emulsion B-H.

(Sensitizing Dye A)

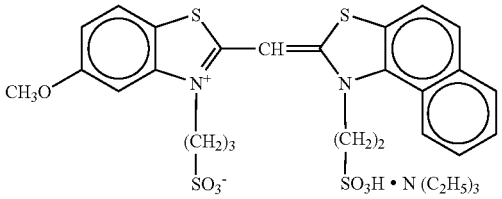

(Sensitizing Dye B)

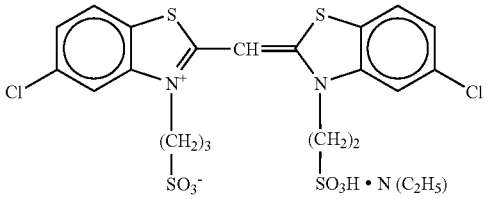

(Preparation of Emulsion B-L)

A cubic high silver chloride emulsion having an equivalent-sphere diameter of 0.45 μm and a variation coefficient of 10% was prepared by changing only the addition rates of silver nitrate and sodium chloride in the preparation of Emulsion B-H. The obtained emulsion was designated as Emulsion B-L.

(Preparation of Emulsion G-1)

A cubic high silver chloride emulsion having an equivalent-sphere diameter of 0.40 μm and a variation coefficient of 10% was prepared by an ordinary method of simultaneously adding and mixing silver nitrate and sodium chloride in an aqueous gelatin solution under stirring. However, between the time when 80% of silver nitrate was added and the time when 100% of silver nitrate was added, potassium bromide (4 mol % per mol of finished silver halide) was added. Also, at the time when 90% of silver nitrate was added, potassium iodide (0.2 mol % per mol of finished silver halide) was added. The obtained emulsion was desalted and after adding gelatin, re-dispersed. Thereafter, sodium benzenethiosulfonate was added thereto and the resulting emulsion was optimally ripened by using thioglucose gold as the sensitizer. Thereto, Sensitizing Dye D, 1-phenyl-5-mercaptotetrazole, 1-(5-methylureido-phenyl)-5-mercaptotetrazole and potassium bromide were further added. The thus-obtained emulsion was designated as Emulsion G-1.

(Sensitizing Dye D)

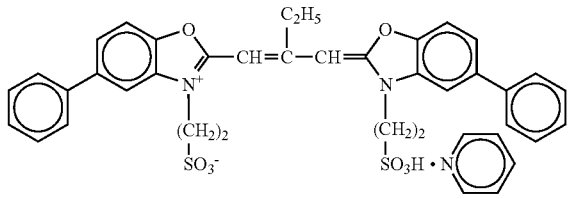

(Preparation of Emulsion G-2)

Emulsion G-2 was prepared in the same manner as Emulsion G-1 except that between the time when 90% of silver nitrate was added and the time when 100% of silver nitrate was added,. $K_2[IrCl_5(H_2O)]$ (average electron releasing time: about $7\times10^{-4}$ seconds) was added in an amount of $6\times10^{-6}$ mol in terms of Ir per mol of finished silver halide.

(Preparation of Emulsion G-3)

Emulsion G-3 was prepared in the same manner as Emulsion G-1 except that between the time when 80% of silver nitrate was added and the time when 90% of silver nitrate was added, $K_2[IrCl_5(\text{methylthiazole})]$ (average electron releasing time: about $5\times10^{-2}$ seconds) was added in an amount of $2\times10^{-6}$ mol in terms of Ir per mol of finished silver halide.

(Preparation of Emulsion G-4)

Emulsion G-4 was prepared in the same manner as Emulsion G-1 except that between the time when 80% of silver nitrate was added and the time when 90% of silver nitrate was added, $K_2[IrCl_5(\text{methylthiourea})]$ (average electron releasing time; about $3\times10^{-2}$ seconds) was added in an amount of $1.6\times10^{-6}$ mol in terms of Ir per mol of finished silver halide.

(Preparation of Emulsion G-5)

Emulsion G-5 was prepared in the same manner as Emulsion G-1 except that between the time when 80% of silver nitrate was added and the time when 90% of silver nitrate was added, $K_2[IrCl_5(\text{methylthiazole})]$ (average electron releasing time: about $5\times10^{-2}$ seconds) was added in an amount of $6\times10^{-7}$ mol in terms of Ir per mol of finished silver halide and between the time when 90% of silver nitrate was added and the time when 100% of silver nitrate was added, $K_2[IrCl_5(H_2O)]$ (average electron releasing time: about $7\times10^{-4}$ seconds) was added in an amount of $4\times10^{-6}$ mol in terms of Ir per mol of finished silver halide.

(Preparation of Emulsion G-6)

Emulsion G-6 was prepared in the same manner as Emulsion G-1 except that between the time when 80% of silver nitrate was added and the time when 90% of silver nitrate was added, $K_2[IrCl_5(\text{S-methylthiourea})]$ (average electron releasing time: about $3\times10^{-2}$ seconds) was added in an amount of $6\times10^{-7}$ mol in terms of Ir per mol of finished silver halide and between the time when 90% of silver nitrate was added and the time when 100% of silver nitrate was added, $K_2[IrCl_5(H_2O)]$ (average electron releasing time:

about $7\times10^{-4}$ seconds) was added in an amount of $4\times10^{-6}$ mol in terms of Ir per mol of finished silver halide.

(Preparation of Emulsion R-H)

A cubic high silver chloride emulsion having an equivalent-sphere diameter of 0.35 μm and a variation coefficient of 10% was prepared by an ordinary method of simultaneously adding and mixing silver nitrate and sodium chloride in an aqueous gelatin solution under stirring. However, between the time when 80% of silver nitrate was added and the time when 90% of silver nitrate was added, $K_4[Ru(CN)_6]$ was added. Also, between the time when 80% of silver nitrate was added and the time when 100% of silver nitrate was added, potassium bromide (4.3 mol % per mol of finished silver halide) was added and between the time when 83% of silver nitrate was added and the time when 88% of silver nitrate was added, $K_2[IrCl_6]$ was added. Furthermore, at the time when 90% of silver nitrate was added, potassium iodide (0.15 mol % per mol of finished silver halide) was added. The obtained emulsion was desalted and after adding gelatin, re-dispersed. Thereafter, sodium benzenethiosulfonate was added thereto and the resulting emulsion was optimally ripened by using sodium thiosulfate pentahydrate as the sulfur sensitizer and bis(1,4,5-trimethyl-1,2, 4-triazolium-3-thiolate)aurate(I) tetra-fluoroborate as the gold sensitizer. Thereto, Sensitizing Dye H, 1-phenyl-5-mercaptotetrazole, 1-(5-methylureido-phenyl)-5-mercaptotetrazole, Compound I and potassium bromide were further added. The thus-obtained emulsion was designated as Emulsion R-H.

(Sensitizing Dye H)

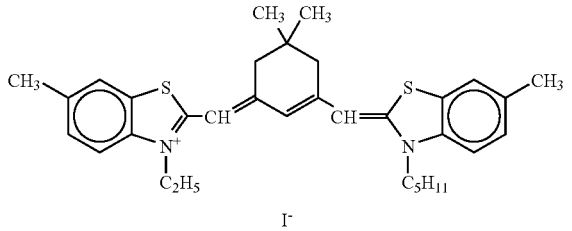

(Compound I)

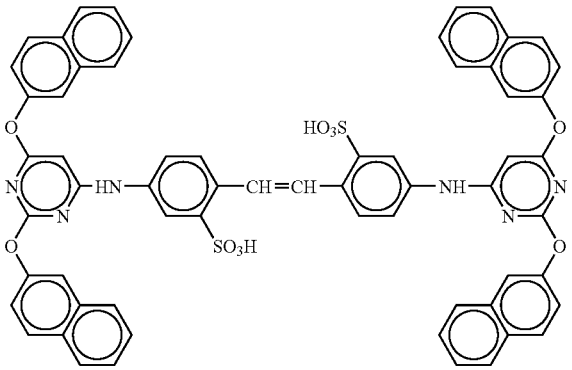

(Preparation of Emulsion R-L)

A cubic high silver chloride emulsion having an equivalent-sphere diameter of 0.28 μm and a variation coefficient of 10% was prepared by changing only the addition rates of silver nitrate and sodium chloride in the preparation of Emulsion R-H. The obtained emulsion was designated as Emulsion R-L.

In order to examine the sensitivity of Emulsions G-1 to G-6, the following samples were prepared.

The surface of a paper support with both surfaces thereof being coated by a polyethylene resin was subjected to a corona discharge treatment and after providing thereon a gelatin undercoat layer containing sodium dodecylbenzenesulfonate, photographic constituent layers of first to seventh layers were sequentially coated to produce a silver halide color photographic light-sensitive material sample having the following layer structure. The coating solution for each photographic constituent layer was prepared as follows.

Preparation of Coating Solution for First Layer:

In 21 g of Solvent (Solv-1) and 80 ml of ethyl acetate, 57 g of Yellow Coupler (ExY), 7 g of Dye Image Stabilizer (Cpd-1), 4 g of Dye Image Stabilizer (Cpd-2), 7 g of Dye Image Stabilizer (Cpd-3) and 2 g of Dye Image Stabilizer (Cpd-8) were dissolved. The resulting solution was emulsion-dispersed in 220 g of an aqueous 23.5 mass % gelatin solution containing 4 g of sodium dodecylbenzene-sulfonate by a high-speed stirring emulsifier (dissolver) and thereto, water was added to prepare 900 g of Emulsified Dispersion A. Emulsified Dispersion A and Emulsion B-H were mixed and dissolved to prepare a coating solution for the first layer to have a composition shown later. The amount of emulsion coated is a coated amount in terms of silver.

The coating solutions for the second to seventh layers were prepared in the same manner as the coating solution for the first layer. In each layer, 1-oxy-3,5-dichloro-s-triazine sodium salts (H-1), (H-2) and (H-3) were used as the gelatin hardening agent. Furthermore, in each layer, Ab-1, Ab-2, Ab-3 and Ab-4 were added each to give a total coverage of 15.0 mg/m$^2$, 60.0 mg/m$^2$, 5.0 mg/m$^2$ and 10.0 mg/m$^2$, respectively.

Hardening Agent (H-1):

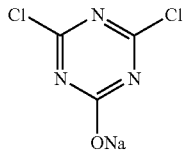

(1.4 mass % per gelatin)

Hardening Agent (H-2):

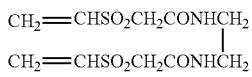

Hardening Agent (H-3):

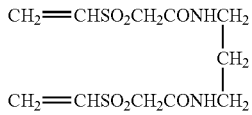

Antiseptic (Ab-1):

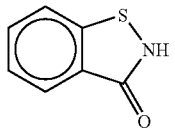

Antiseptic (Ab-2):

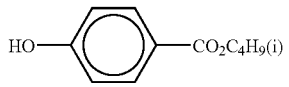

Antiseptic (Ab-3):

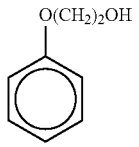

Antiseptic (Ab-4):

A 1:1:1:1 (by mol) mixture of a, b, c and d.

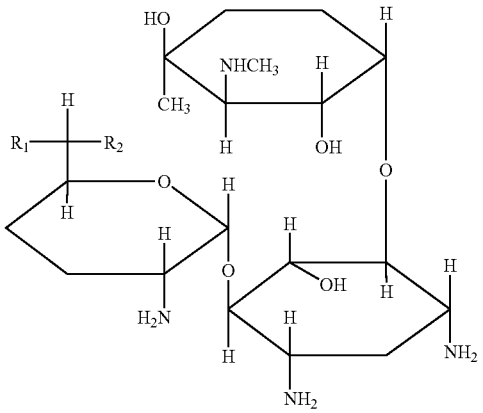

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

In addition, 1-phenyl-5-mercaptotetrazole was added to the green-sensitive emulsion layer and the red-sensitive emulsion layer to give a coverage of $1.0\times10^{-3}$ mol and $5.9\times10^{-4}$ mol, respectively, per mol of silver halide. The 1-phenyl-5-mercaptotetrazole was also added to the second, fourth and sixth layers to give a coverage of 0.2 mg/m$^2$, 0.2 mg/m$^2$ and 0. 6 mg/m$^2$, respectively. In the red-sensitive layer, 0.05 g/m$^2$ of a copolymer latex of methacrylic acid and butyl acrylate (mass ratio: 1:1, average molecular weight: 200,000 to 400,000) was added. Furthermore, disodium catechol-3,5-disulfonate was added to the second, fourth and sixth layers to give a coverage of 6 mg/m$^2$, 6 mg/m$^2$ and 18 mg/m$^2$, respectively. For the purpose of preventing irradiation, the dyes shown below (in the parenthesis, the amount coated is shown) were added.

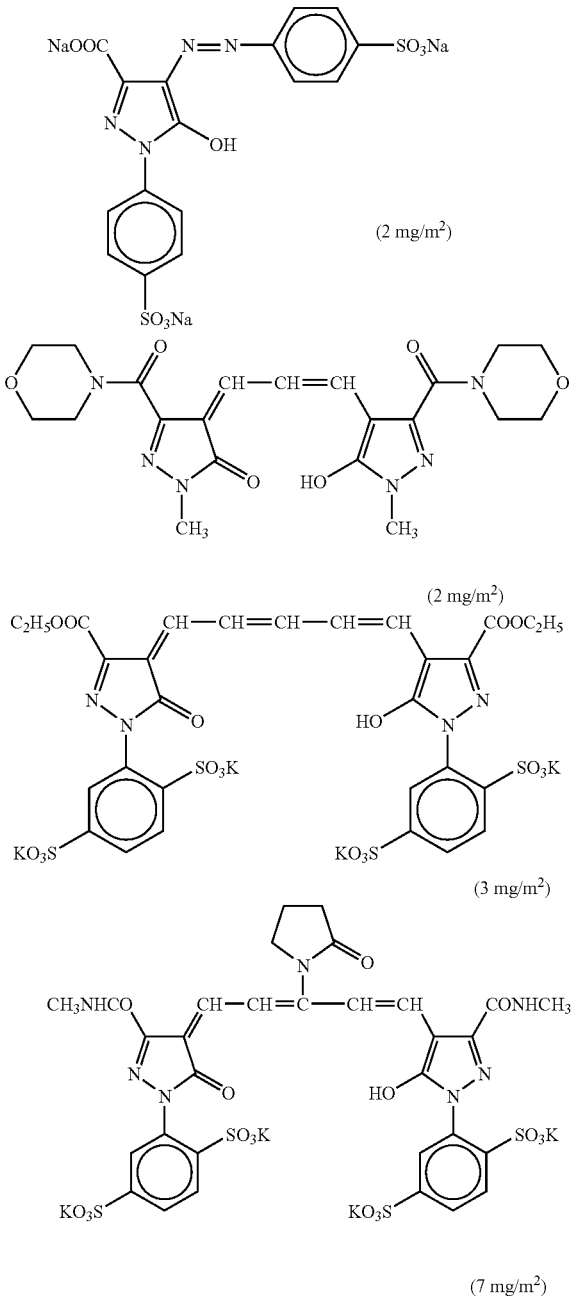

(Layer Structure)

Each layer had a constitution shown below. The numeral shows the amount coated (g/m$^2$). In the case of silver halide emulsion, an amount coated in terms of silver is shown.

Support:

Polyethylene Resin-laminated Paper

[The polyethylene resin in the first layer side contained white pigments ($TiO_2$ (content); 16 mass %, ZnO (content): 4 mass %), a fluorescent brightening agent (4,4'-bis(5-methylbenzoxazolyl)stilbene, content: 0.03 mass %) and a bluish dye (ultramarine).]

| | |
|---|---|
| First Layer (blue-sensitive emulsion layer) | |
| Emulsion B-H | 0.09 |
| Emulsion B-L | 0.10 |
| Gelatin | 1.00 |
| Yellow Coupler (Ex-Y) | 0.46 |
| Dye Image Stabilizer (Cpd-1) | 0.06 |
| Dye Image Stabilizer (Cpd-2) | 0.03 |
| Dye Image Stabilizer (Cpd-3) | 0.06 |
| Dye Image Stabilizer (Cpd-8) | 0.02 |
| Solvent (Solv-1) | 0.17 |
| Second Layer (color mixing inhibiting layer): | |
| Gelatin | 0.50 |
| Color Mixing Inhibitor (Cpd-4) | 0.05 |
| Dye Image Stabilizer (Cpd-5) | 0.01 |
| Dye Image Stabilizer (Cpd-6) | 0.06 |
| Dye Image Stabilizer (Cpd-7) | 0.01 |
| Solvent (Solv-1) | 0.03 |
| Solvent (Solv-2) | 0.11 |
| Third Layer (green-sensitive emulsion layer): | |
| Emulsion G-1 | 0.12 |
| Gelatin | 1.36 |
| Magenta Coupler (ExM) | 0.15 |
| Ultraviolet Absorbent (UV-A) | 0.14 |
| Dye Image Stabilizer (Cpd-2) | 0.02 |
| Dye Image Stabilizer (Cpd-4) | 0.002 |
| Dye Image Stabilizer (Cpd-6) | 0.09 |
| Dye Image Stabilizer (Cpd-8) | 0.02 |
| Dye Image STabilizer (Cpd-9) | 0.03 |
| Dye Image Stabilizer (Cpd-10) | 0.01 |
| Dye Image Stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (color mixing inhibiting layer): | |
| Gelatin | 0.36 |
| Color Mixing Inhibitor (Cpd-4) | 0.03 |
| Dye Image Stabilizer (Cpd-5) | 0.006 |
| Dye Image Stabilizer (Cpd-6) | 0.05 |
| Dye Image Stabilizer (Cpd-7) | 0.004 |
| Solvent (Solv-1) | 0.02 |
| Solvent (Solv-2) | 0.08 |
| Fifth Layer (red-sensitive emulsion layer): | |
| Emulsion R-H | 0.05 |
| Emulsion R-L | 0.05 |
| Gelatin | 1.11 |
| Cyan Coupler (ExC-2) | 0.13 |
| Cyan Coupler (ExC-3) | 0.03 |
| Dye Image Stabilizer (Cpd-1) | 0.05 |
| Dye Image Stabilizer (Cpd-6) | 0.06 |
| Dye Image Stabilizer (Cpd-7) | 0.02 |
| Dye Image STabilizer (Cpd-9) | 0.04 |
| Dye Image Stabilizer (Cpd-10) | 0.01 |
| Dye Image Stabilizer (Cpd-14) | 0.01 |
| Dye Image Stabilizer (Cpd-15) | 0.12 |
| Dye Image Stabilizer (Cpd-16) | 0.03 |
| Dye Image Stabilizer (Cpd-17) | 0.09 |
| Dye Image Stabilizer (Cpd-18) | 0.07 |
| Solvent (Solv-5) | 0.15 |
| Solvent (Solv-8) | 0.05 |
| Sicth Layer (Ultraviolet absorbing layer): | |
| Gelatin | 0.46 |
| Ultraviolet Absorbent (UV-B) | 0.45 |
| Compound (S1-4) | 0.0015 |
| Solvent (Solv-7) | 0.25 |
| Seventh Layer (protective layer): | |
| Gelatin | 1.00 |
| Acryl-moidified copolymer of polyvinyl alcohol (modification degree: 17%) | 0.04 |
| Liquid paraffin | 0.02 |
| Surfactant (Cpd-13) | 0.01 |

-continued
Yellow Coupler (Ex-Y):
A 70:30 (by mol) mixture of
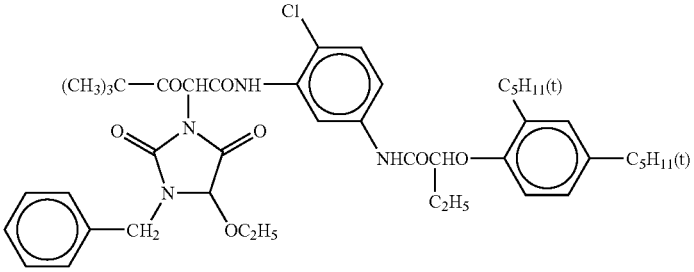
and
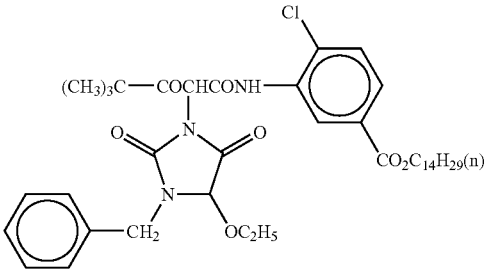
Magenta Coupler (ExM):
A 40:40:20 (by mol) mixture of
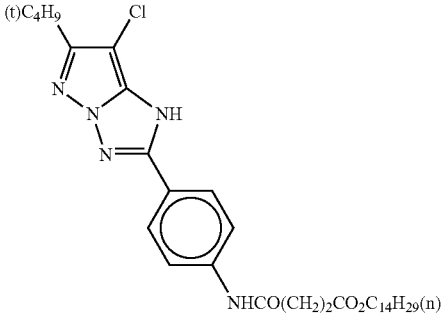
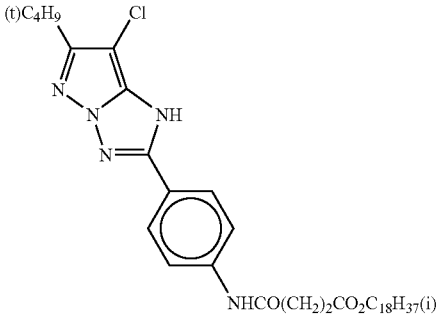
and -continued
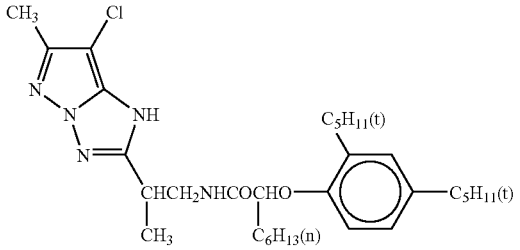
Cyan Coupler (ExC-2):
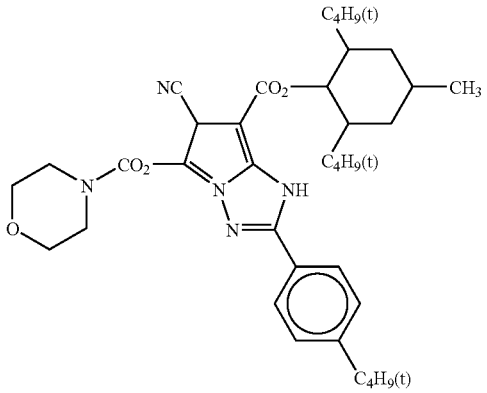
Cyan Coupler (ExC-3):
A 50:25:25 (by mol) mixture of
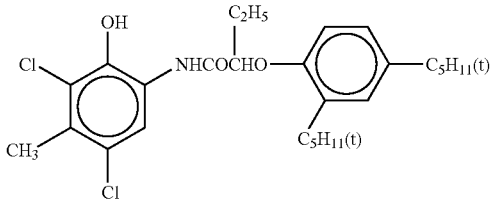
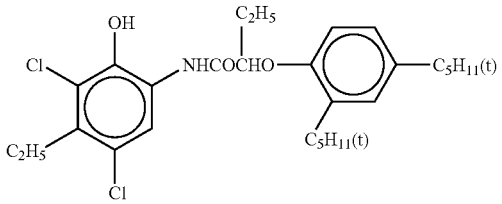
and
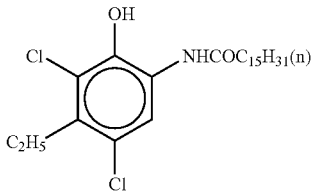
Dye Image Stabilizer (Cpd-1):
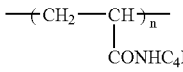

-continued
Number average molecular weight: 60,000
Dye Image Stabilizer (Cpd-2):
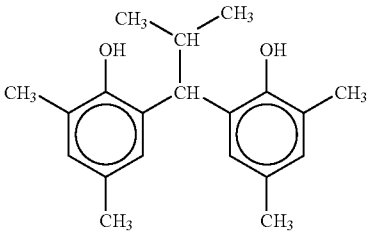
Dye Image Stabilizer (Cpd-3):
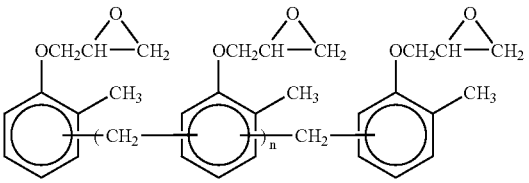
n: 7 to 8 (average)
Color Mixing Inhibitor (Cpd-4):
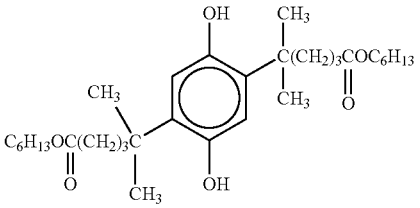
Dye Image Stabilizer (Cpd-5):
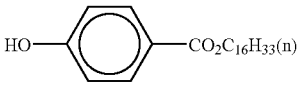
Dye Image Stabilizer (Cpd-6):
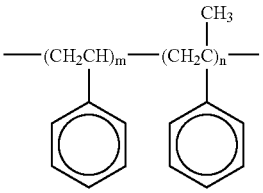
Number average molecular weight: 600
m/n = 10/90
Dye Image Stabilizer (Cpd-7):
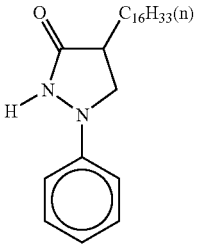

-continued
Dye Image Stabilizer (Cpd-8):
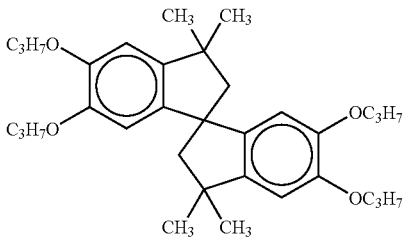
Dye Image Stabilizer (Cpd-9):
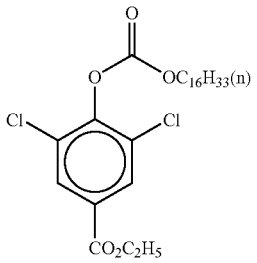
Dye Image Stabilizer (Cpd-10):
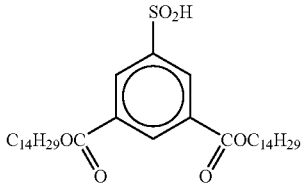
(Cpd-11)
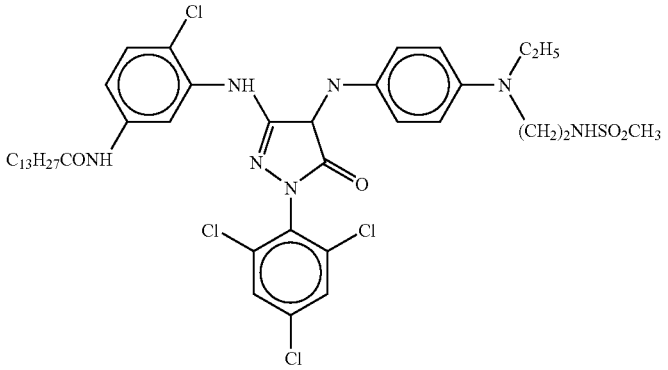
Surfactant (Cpd-13)
A 7:3 (by mol) mixture of
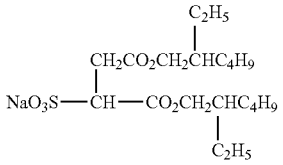
and -continued
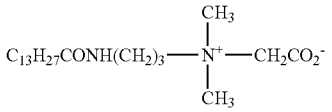
(Cpd-14)
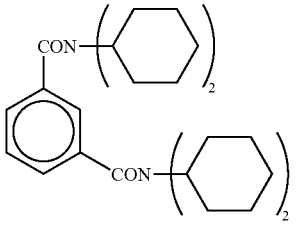
(Cpd-15)
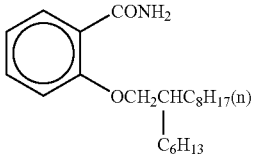
(Cpd-16)
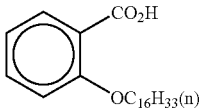
(Cpd-17)
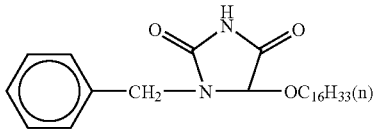
(Cpd-18)
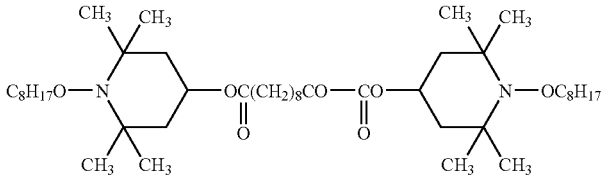
Color Mixing Inhibitor (Cpd-19)
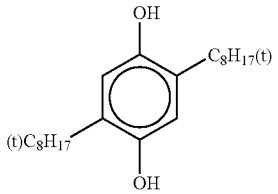

-continued
Ultraviolet Absorbent (UV-1):
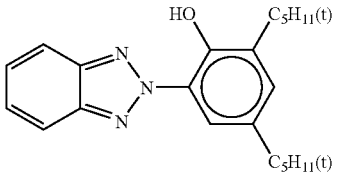
Ultraviolet Absorbent (UV-2):
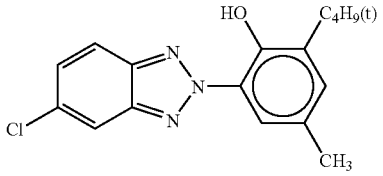
Ultraviolet Absorbent (UV-3):
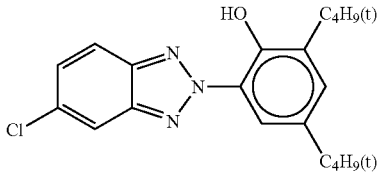
Ultraviolet Absorbent (UV-4):
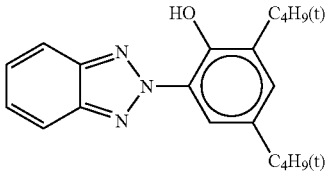
Ultraviolet Absorbent (UV-5):
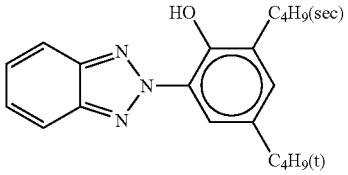
Ultraviolet Absorbent (UV-6):
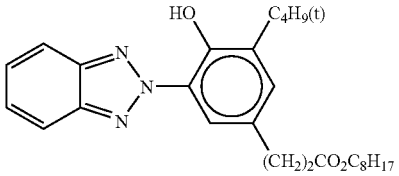

-continued
Ultraviolet Absorbent (UV-7):
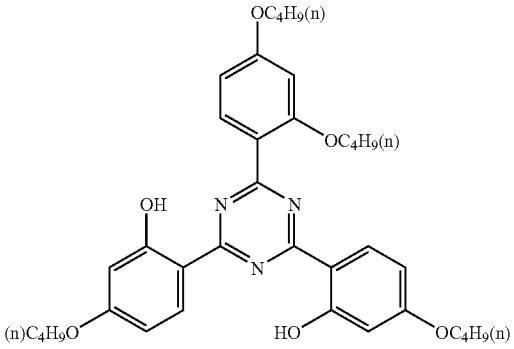
UV-A:
A 4/2/2/3 (by masws) mixture of UV-1/UV-2/UV-3/UV-4
UV-B:
A 9/3/3/4/5/3 (by mass) mixture of UV-1/UV-2/UV-3/UV-4/UV-5/UV-6
UV-C:
A 1/1/1/2 (by mass) mixture of UV-2/UV-3/UV-6/UV-7
(Solv-1)
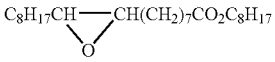
(Solv-2)
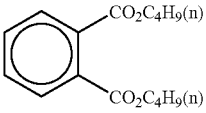
(Solv-3)
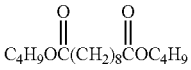
(Solv-4)
$O{=}P(OC_6H_{13}(n))_3$
(Solv-5)
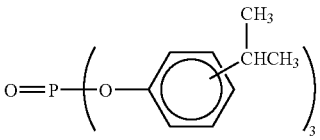
(Solv-7)
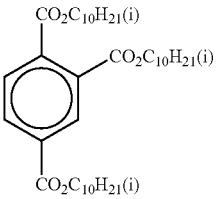

-continued (Solv-8)

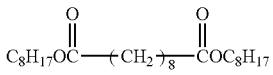

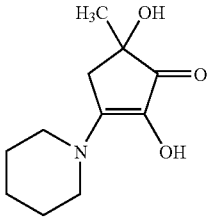

The thus-obtained sample was designated as Sample 101. In order to examine the sensitivity of Emulsions G-1 to G-6, Samples 102 to 106 were prepared in the same manner except that the emulsion in the green-sensitive emulsion layer of Sample 101 was replaced by G-2 to G-6, respectively.

Each coated sample was placed in an atmosphere of 20° C. and 30% RH and subjected to $10^{-4}$-second or $10^{-6}$-second high illuminance gradation exposure for sensitometry through a green filter by using a sensitometer for high illuminance exposure (Model HIE, manufactured by Yamashita Denso). After the exposure, each sample was subjected to the following color development processing.

The processing steps are described below.

[Processing]

A continuous processing was performed using Sample 101 through the following processing steps until the volume of replenisher for the color developer reached 0.5 times the volume of the color development tank. Thereafter, each sample was processed.

| Processing Step | Temperature (° C.) | Time (sec) | Replenishing Amount* (ml) |
|---|---|---|---|
| Color development | 45.0 | 16 | 45 |
| Bleach-fixing | 40.0 | 16 | 35 |
| Rinsing 1 | 40.0 | 8 | — |
| Rinsing 2 | 40.0 | 8 | — |
| Rinsing 3** | 40.0 | 8 | — |
| Rinsing 4 | 38.0 | 8 | 121 |
| Drying | 80.0 | 16 | |

(Notes)

*Replenishing amount per 1 $m^2$ of the light-sensitive material.

**Rinse Cleaning System RC50D manufactured by Fuji Photo Film Co., Ltd. was installed to Rinsing (3) and the rinsing solution was taken out from Rinsing (3) and transferred by a pump to a reverse osmosis membrane module (RC50D). The permeated water obtained in the tank was fed to the rinsing and the concentrated water was returned to Rinsing (3). The pump pressure was adjusted such that the amount of water permeated to the reverse osmosis module was kept to 50 to 300 ml/min.The rinsing solution was circulated under control of temperature for 10 hours per day. The rinsing was performed in a four-tank counter-current system from (1) to (4).

Each processing solution had the following composition.

| | [Tank Solution] | [Replenisher] |
|---|---|---|
| [Color Developer] | | |
| Water | 800 ml | 600 ml |
| Fluorescent brightening agent (FL-1) | 5.0 g | 8.5 g |
| Triisopropanolamine | 8.8 g | 8.8 g |
| Sodium p-toluenesulfonate | 20.0 g | 20.0 g |
| Ethylenediaminetetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.50 g | 0.50 g |
| Disodium N,N-bis(sulfonato-ethyl)hydroxylamine | 8.5 g | 14.5 g |
| 4-Amino-3-methyl-N-ethyl-N-(β-methanesulfonamidoethyl)-aniline 3/2-sulfate monohydrate | 10.0 g | 22.0 g |
| Potassium carbonate | 26.3 g | 26.3 g |

-continued

| | [Tank Solution] | [Replenisher] |
|---|---|---|
| Water to make in total | 1,000 ml | 1,000 ml |
| pH (at 25° C., adjusted by sulfuric acid and KOH) | 10.35 | 12.6 |
| [Bleach-Fixing Solution] | | |
| Water | 800 ml | 800 ml |
| Ammonium thiosulfate (750 g/ml) | 107 ml | 214 ml |
| Succinic acid | 29.5 g | 59.0 g |
| Ammonium ethylenediamine-tetraacetatoferrate | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make in total | 1,000 ml | 1,000 ml |
| pH (at 25° C., adjusted by nitric acid and aqueous ammonia) | 6.00 | 6.00 |
| [Rinsing Solution] | | |
| Chlorinated sodium isocyanurate | 0.02 g | 0.02 g |
| Deionized water (electrical conductivity: 5 μS/cm or less) | 1,000 ml | 1,000 ml |
| pH | 6.5 | 6.5 |

FL-1:

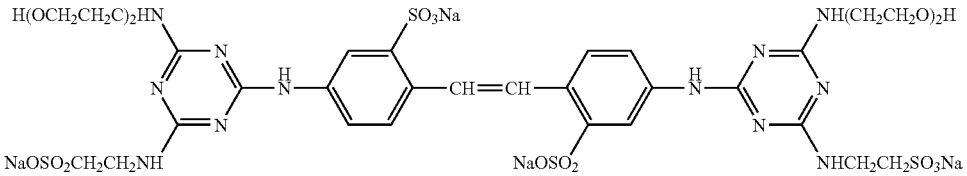

After the processing, the magenta color density of each sample was measured to obtain a characteristic curve. From the logarithm of the exposure amount E necessary for giving a color density of 1.7 of each sample, the sensitivity of each emulsion was read. The difference of sensitivity between the case where the sample was exposed for $10^{-4}$ seconds and after 6 seconds, processed and the case where the sample was exposed for $10^{-6}$ seconds and after 6 seconds, processed was assumed as ΔS. In all samples, the sensitivity in the $10^{-6}$ second exposure was lower than in the $10^{-4}$ second exposure. A smaller ΔS reveals less high illuminance failure from $10^{-4}$ second to $10^{-6}$ second exposure. Also, the change of density when the sample was processed 60 seconds after the same exposure with an exposure amount of giving a density of 1.7 at the time of performing the processing 6 seconds after $10^{-6}$-second exposure was assumed as ΔD. In all samples, the density was increased in 60-second latent image from 6-second latent image. A smaller ΔD reveals higher stability of the latent image.

The results obtained are shown in Table 2. When the emulsion of the present invention is used, the sample obtained is decreased in the high illuminance failure from $10^{-4}$ second to $10^{-6}$ second and ensured with stable preservability of latent image, revealing suitability for digital exposure by laser scanning exposure.

TABLE 2

| Sample | Dopant | ΔS | ΔD | Remarks |
|---|---|---|---|---|
| 101 | None | 0.19 | 0.05 | Comparison |
| 102 | $K_2[IrCl_5(H_2O)$ | 0.12 | 0.06 | Comparison |
| 103 | $K_2[IrCl_5$(5-methylthiazole)] | 0.09 | 0.21 | Comparison |
| 104 | $K_2[IrCl_5$(S-methylthiourea)] | 0.10 | 0.16 | Comparison |
| 105 | $K_2[IrCl_5(H_2O)]$/ $K_2[IrCl_5$(5-methylthiazole)] | 0.03 | 0.06 | Invention |
| 106 | $K_2[IrCl_5(H_2O)]$/ $K_2[IrCl_5$(S-methylthiourea)] | 0.04 | 0.05 | Invention |

(Preparation of Emulsion B-1)

A cubic high silver chloride emulsion having an equivalent-sphere diameter of 0.53 μm and a variation coefficient of 10% was prepared by an ordinary method of simultaneously adding and mixing silver nitrate and sodium chloride in an aqueous gelatin solution under stirring. However, between the time when 80% of silver nitrate was added and the time when 90% of silver nitrate was added, potassium bromide (2 mol % per mol of finished silver halide) and $K_4[Ru(CN)_6]$ were added. Also, between the time when 83% of silver nitrate was added and the time when 88% of silver nitrate was added, $K_2[IrCl_6]$ was added, and at the time when 90% of silver nitrate was added, potassium iodide (0.23 mol % per mol of finished silver halide) was added. The obtained emulsion was desalted and after adding gelatin, re-dispersed. Thereafter, sodium benzenethio-sulfonate, Sensitizing Dye A and Sensitizing Dye B were added thereto and the resulting emulsion was optimally ripened by using thioglucose gold as the sensitizer. Thereto, 1-phenyl-5-mercaptotetrazole and 1-(5-methyl-ureidophenyl)-5-mercaptotetrazole were further added. The thus-obtained emulsion was designated as Emulsion B-1.

(Preparation of Emulsion B-2)

A cubic high silver chloride emulsion having an equivalent-sphere diameter of 0.43 μm and a variation coefficient of 10% was prepared by an ordinary method of simultaneously adding and mixing silver nitrate and sodium chloride in an aqueous gelatin solution under stirring. However, between the time when 80% of silver nitrate was added and the time when 90% of silver nitrate was added, potassium bromide (2 mol % per mol of finished silver halide) and $K_4[Ru(CN)_6]$ were added. Also, between the time when 83% of silver nitrate was added and the time when 88% of silver nitrate was added, $K_2[IrCl_6]$ was added, and at the time when 90% of silver nitrate was added, potassium iodide (0.23 mol % per mol of finished silver halide) was added. The obtained emulsion was desalted and after adding gelatin, re-dispersed. Thereafter, sodium benzenethio-sulfonate, Sensitizing Dye A and sensitizing Dye B were added thereto and the resulting emulsion was optimally ripened by using thioglucose gold as the sensitizer. Thereto, 1-phenyl-5-mercaptotetrazole and 1-(5-methyl-ureidophenyl)-5-mercaptotetrazole were further added. The thus-obtained emulsion was designated as Emulsion B-2.

(Preparation of Emulsion G-11)

A cubic high silver chloride emulsion having an equivalent-sphere diameter of 0.38 μm and a variation coefficient of 10% was prepared by an ordinary method of simultaneously adding and mixing silver nitrate and sodium chloride in an aqueous gelatin solution under stirring. However, between the time when 80% of silver nitrate was added and the time when 90% of silver nitrate was added, $K_4(Ru(CN)_6]$ was added. Also, between the time when 80% of silver nitrate was added and the time when 100% of silver nitrate was added, potassium bromide (3 mol % per mol of finished silver halide) was added and between the time when 83% of silver nitrate was added and the time when 88% of silver nitrate was added, $K_2[IrCl_6]$ was added. Furthermore, at the time when 90% of silver nitrate was added, potassium iodide (0.15 mol % per mol of finished silver halide) was added. The obtained emulsion was desalted and after adding gelatin, re-dispersed. Thereafter, sodium benzenethio-sulfonate was added thereto and the resulting emulsion was optimally ripened by using thioglucose gold as the sensitizer. Thereto, Sensitizing Dye D, 1-phenyl-5-mercaptotetrazole, 1-(5-methylureidophenyl)-5-mercapto-tetrazole and potassium bromide were further added. The thus-obtained emulsion was designated as Emulsion G-11.

(Preparation of Emulsion G-12)

Emulsion G-12 was prepared in the same manner as Emulsion G-11 except that $K_2[IrCl_6]$ was not added to Emulsion G-11 and also except that between the time when 80% of silver nitrate was added and the time when 90% of silver nitrate was added, $K_2[IrCl_5(5\text{-methylthia})]$ (average electron releasing time: about $5\times10^{-2}$ seconds) was added in an amount of $1\times10^{-6}$ mol in terms of Ir per mol of finished silver halide and between the time when 90% of silver nitrate was added and the time when 100% of silver nitrate was added, $K_2[IrCl_5(H_2O)]$ (average electron releasing time: about $7\times10^{-4}$ seconds) was added in an amount of $4\times10^{-6}$ mol in terms of Ir per mol of finished silver halide.

(Preparation of Emulsion G-13)

Emulsion G-13 was prepared in the same manner as Emulsion G-12 except that between the time when 50% of silver nitrate was added and the time when 80% of silver nitrate was added, $Cs_2[OsCl_5(NO)]$ was added in an amount of $6\times10^{-8}$ mol in terms of Ir per mol of silver halide.

(Preparation of Emulsion G-14)

Emulsion G-14 was prepared in the same manner as Emulsion G-12 except that between the time when 50% of silver nitrate was added and the time when 80% of silver nitrate was added, $Cs_2[OsCl_5(NO)]$ was added in an amount of $6\times10^{-8}$ mol in terms of Ir per mol of silver halide and also except that in place of $K_2[IrCl_5(5\text{-methylthia})]$, $K_2[IrCl_5(S\text{-methylthiourea})]$ (average electron releasing time: about $3\times10^{-2}$ seconds) was added in an amount of $4\times10^{-7}$ mol in terms of Ir per mol of silver halide.

(Preparation of Emulsion R-1)

A cubic high silver chloride emulsion having an equivalent-sphere diameter of 0.38 μm and a variation coefficient of 10% was prepared by an ordinary method of simultaneously adding and mixing silver nitrate and sodium chloride in an aqueous gelatin solution under stirring. However, between the time when 80% of silver nitrate was added and the time when 90% of silver nitrate was added, $K_4[RU(CN)_6]$ was added. Also, between the time when 80% of silver nitrate was added and the time when 100% of silver nitrate was added, potassium bromide (3 mol % per mol of finished silver halide) was added and between the time when 83% of silver nitrate was added and the time when 88% of silver nitrate was added, $K_2[IrCl_6]$ was added. Furthermore, at the time when 90% of silver nitrate was added, potassium iodide (0.15 mol % per mol of finished silver halide) was added. The obtained emulsion was desalted and after adding gelatin, re-dispersed. Thereafter, sodium benzenethio-sulfonate was added thereto and the resulting emulsion was optimally ripened by using sodium thiosulfate pentahydrate as the sulfur sensitizer and bis(1,4,5-trimethyl-1,2,4-triazolium-3-thiolate)aurate(I) tetrafluoroborate as the gold sensitizer. Thereto, Sensitizing Dye H, 1-phenyl-5-mercaptotetrazole, 1-(5-methylureidophenyl)-5-mercapto-tetrazole, Compound I and potassium bromide were further added. The thus-obtained emulsion was designated as Emulsion R-1.

(Preparation of Emulsion R-2)

A cubic high silver chloride emulsion having an equivalent-sphere diameter of 0.28 μm and a variation coefficient of 10% was prepared by an ordinary method of simultaneously adding and mixing silver nitrate and sodium chloride in an aqueous gelatin solution under stirring. However, between the time when 80% of silver nitrate was added and the time when 90% of silver nitrate was added, $K_4[Ru(CN)_6]$ was added. Also, between the time when 80% of silver nitrate was added and the time when 100% of silver nitrate was added, potassium bromide (3 mol % per mol of finished silver halide) was added and between the time when 83% of silver nitrate was added and the time when 88% of silver nitrate was added, $K_2[IrCl_6]$ was added. Furthermore, at the time when 90% of silver nitrate was added, potassium iodide (0.15 mol % per mol of finished silver halide) was added. The obtained emulsion was desalted and after adding gelatin, re-dispersed. Thereafter, sodium benzenethio-sulfonate was added thereto and the resulting emulsion was optimally ripened by using sodium thiosulfate pentahydrate as the sulfur sensitizer and bis(1,4,5-trimethyl-1,2,4-triazolium-3-thiolate)aurate(I) tetrafluoroborate as the gold sensitizer. Thereto, Sensitizing Dye H, 1-phenyl-5-mercaptotetrazole, 1-(5-methylureidophenyl)-5-mercapto-tetrazole, Compound I and potassium bromide were further added. The thus-obtained emulsion was designated as Emulsion R-2.

Using the emulsions prepared above, the following sample was produced.

| | |
|---|---|
| First Layer (blue-sensitive emulsion layer): | |
| Emulsion B-1 | 0.07 |
| Emulsion B-2 | 0.07 |
| Gelatin | 0.75 |
| Yellow Coupler (Ex-Y) | 0.34 |
| Dye Image Stabilizer (Cpd-1) | 0.04 |
| Dye Image Stabilizer (Cpd-2) | 0.02 |
| Dye Image Stabilizer (Cpd-3) | 0.04 |
| Dye Image Stabilizer (Cpd-8) | 0.01 |
| Solvent (Solv-1) | 0.13 |
| Second Layer (color mixing inhibiting layer): | |
| Gelatin | 0.60 |
| Color Mixing Inhibitor (Cpd-19) | 0.09 |
| Dye Image Stabilizer (Cpd-5) | 0.007 |
| Dye Image Stabilizer (Cpd-7) | 0.007 |
| Ultraviolet Absorbent (UV-C) | 0.05 |
| Solvent (Solv-5) | |
| Third Layer (green-sensitive emulsion layer): | |
| Emulsion G-11 | 0.11 |
| Gelatin | 0.73 |
| Magenta Coupler (ExM) | 0.15 |
| Ultraviolet Absorbent (UV-A) | 0.05 |
| Dye Image Stabilizer (Cpd-2) | 0.02 |
| Dye Image Stabilizer (Cpd-7) | 0.008 |
| Dye Image Stabilizer (Cpd-8) | 0.07 |
| Dye Image Stabilizer (Cpd-9) | 0.03 |
| Dye Image Stabilizer (Cpd-10) | 0.009 |
| Dye Image Stabilizer (Cpd-11) | 0.0001 |
| Solvent (Solv-3) | 0.06 |
| Solvent (Solv-4) | 0.11 |
| Solvent (Solv-5) | 0.06 |
| Fourth Layer (color mixing inhibiting layer): | |
| Gelatin | 0.48 |
| Color Mixing Inhibitor (Cpd-4) | 0.07 |
| Dye Image STabilizer (Cpd-5) | 0.006 |
| Dye Image Stabilizer (Cpd-7) | 0.006 |
| Ultraviolet Absorbent (UV-C) | 0.04 |
| Solvent (Solv-5) | 0.09 |
| Fifth Layer (red-sensitive emulsion layer): | |
| Emulsion R-1 | 0.05 |
| Emulsion R-2 | 0.05 |
| Gelatin | 0.59 |
| Cyan Coupler (ExC-2) | 0.13 |
| Cyan Coupler (ExC-3) | 0.03 |
| Dye Image Stabilizer (Cpd-7) | 0.01 |
| Dye Image Stabilizer (Cpd-9) | 0.04 |
| Dye Image Stabilizer (Cpd-15) | 0.19 |
| Dye Image Stabilizer (Cpd-18) | 0.04 |
| Ultraviolet Absorbent (UV-7) | 0.02 |
| Solvent (Solv-5) | 0.09 |
| Sixth Layer (ultraviolet absorbing layer): | |
| Gelatin | 0.32 |
| Ultraviolet Absorbent (UV-C) | 0.42 |
| Solvent (Solv-7) | 0.08 |
| Seventh Layer (protective layer): | |
| Gelatin | 0.70 |
| Acryl-modified copolymer of polyvinyl alcohol (modification degree: 17%) | 0.04 |
| Liquid paraffin | 0.01 |
| Surfactant (Cpd-13) | 0.01 |
| Polydimethylsiloxane | 0.01 |
| Silicon dioxide | 0.003 |

-continued (ExY-2)

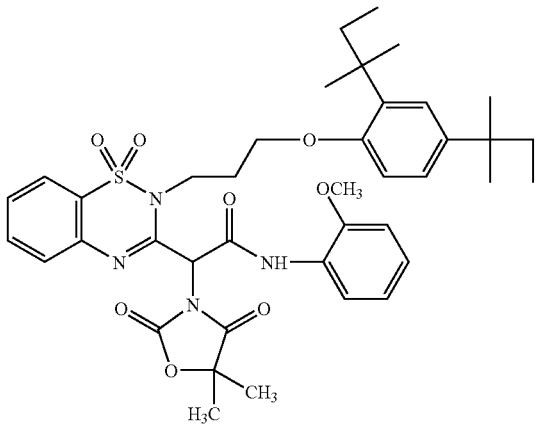

The thus-obtained sample was designated as Sample 201. Samples where Emulsion G-11 was replaced by Emulsions G-12 to G-14 were designated as Samples 202 to 204, respectively.

In order to examine the photographic properties of these samples at the laser scanning exposure, the following test was performed. As the laser light source, a blue semiconductor laser having a wavelength of about 440 nm (published by Nichia Kagaku at 48th Associated Lecture Presentation Relating to Applied Physics (March 2001)), a green laser of about 530 nm taken out by converting the wavelength of a semiconductor laser (oscillation wavelength: about 1,060 nm) with an SHG crystal of $LiNbO_3$ having a waveguide path-like inverted domain structure, and a red semiconductor laser having a wavelength of about 650 nm (Hitachi Type No. HL6501MG) were used. Three color laser rays each was moved by a polygon mirror in the direction perpendicular to the scanning direction so that the sample could be sequentially scan-exposed. The fluctuation in the intensity of light due to temperature of semiconductor lasers was suppressed by keeping constant the temperature using a Peltier element. The effective beam diameter was 80 μm, the scanning pitch was 42.3 μm (600 dpi), and the average exposure time per one picture element was $1.7\times10^{-7}$ seconds. By using this exposure system, gradation exposure of gray color was applied to the sample in an environment of 20° C. and 30% RH.

After exposure, each sample was subjected to the same color development processing as in Example 1. However, the color development at the leading end of the sample was started about 3 seconds after exposure and the color development at the rear end was started about 9 seconds after exposure.

After the processing, the magenta reflection color density of each sample was measured and similarly to Example 1, the sensitivity of each emulsion was read from the exposure amount E necessary for giving a color density of 1.7 of each sample. The sensitivity was expressed by a relative value to the sensitivity of Sample 201 (Emulsion G-11), which was taken as 100. The gradation was read from the gradient between the density of fog+0.1 and the density of fog+0.5.

TABLE 3

| Sample No. | Dopant | Relative Sensitivity*1 | Gradation*2 |
|---|---|---|---|
| 201 (Comparison) | none | 100 | 2.58 |
| 202 (Invention) | $IrCl_5(H_2O)/IrCl_5$(5-Methia) | 158 | 2.50 |
| 203 (Comparison) | $OsCl_5(NO)$ | 180 | 3.67 |
| 204 (Invention) | $OsCl_5(NO)/IrCl_5(H_2O)/IrCl_5$(S-methylthiourea) | 185 | 3.60 |

5-Methia: 5-methylthiazole
*1Relative sensitivity assuming that the sensitivity of Sample 201 at $10^{-4}$-second exposure is 100.
*2Gradation of each sample was expressed by the gradient between fog + 0.1 and fog + 0.5.

As apparent from the results in Table 3, in both of Samples 203 and 203, sensitivity and gradation optimal to laser scanning exposure were obtained in the high color density region. Furthermore, similarly to Example 1, each coated sample was placed in an atmosphere of 20° C. and 30% RH and 6 seconds or 60 seconds after the above-described exposure, processed. Each sample was confirmed to exhibit stable performance irrespective of the time from exposure to development.

EXAMPLE 3

(Preparation of Emulsion Ba)

A cubic high silver chloride emulsion having an equivalent-sphere diameter of 0.46 μm and a variation coefficient of 8% was prepared by an ordinary method of simultaneously adding and mixing silver nitrate and sodium chloride in an aqueous gelatin solution under stirring. However, between the time when 50% of silver nitrate was added and the time when 80% of silver nitrate was added, $Cs_2[OsCl_5(NO)]$ was added in an amount of $1\times10^{-8}$ mol in terms of Ir per mol of silver halide. Also, between the time when 80% of silver nitrate was added and the time when 90% of silver nitrate was added, potassium bromide (0.5 mol % per mol of finished silver halide) and $K_4[Ru(CN)_6]$ were added and between the time when 83% of silver nitrate was added and the time when 88% of silver nitrate was added, $K_2[IrCl_5$(5-methylthia)] (average electron releasing time: about $5\times10^{-2}$ second) was added in an amount of $8\times10^{-7}$ mol in terms of Ir per mol of silver. Furthermore, at the time when 90% of silver nitrate was added, potassium iodide (0.23 mol % per mol of finished silver halide) was added. The obtained emulsion was desalted and after adding gelatin, re-dispersed. Thereafter, sodium benzenethiosulfonate, Sensitizing Dye A and Sensitizing Dye B were added thereto and the resulting emulsion was optimally ripened by using thioglucose gold as the sensitizer. Thereto, 1-phenyl-5-mercaptotetrazole and 1-(5-methylureidophenyl)-5-mercaptotetrazole were further added. The thus-obtained emulsion was designated as Emulsion Ba.

(Preparation of Emulsion Bb)

Emulsion Bb was prepared in the same manner as Emulsion Ba except that the amount of $K_2[IrCl_5$(5-methylthia)] (average electron releasing time: about $5\times10^{-2}$ seconds) added between the time when 83% of silver nitrate was added and the time when 88% of silver nitrate was added was changed to $7\times10^{-7}$ in terms of Ir per mol of silver halide and furthermore, between the time when 90% of silver nitrate was added and the time when 98% of silver nitrate was added, $K_2[IrCl_5(H_2O)]$ (average electron releasing time: about $7\times10^{-4}$ seconds) was added in an amount of $1\times10^{-6}$ mol in terms of Ir per mol of silver halide.

(Preparation of Emulsion Bc)

Emulsion Bc was prepared in the same manner as Emulsion Ba except that the amount of $K_2[IrCl_5$(5-methylthia)] (average electron releasing time: about $5\times10^{-2}$ seconds) added between the time when 83% of silver nitrate was added and the time when 88% of silver nitrate was added was changed to $5\times10^{-7}$ in terms of Ir per mol of silver halide and furthermore, between the time when 90% of silver nitrate was added and the time when 98% of silver nitrate was added, $K_2[IrCl_5(H_2O)]$ (average electron releasing time: about $7\times10^{-4}$ seconds) was added in an amount of $7\times10^{-6}$ mol in terms of Ir per mol of silver halide.

(Preparation of Emulsion Bd)

Emulsion Bd was prepared in the same manner as Emulsion Ba except that the amount of $K_2[IrCl_5$(5-methylthia)] (average electron releasing time: about $5\times10^{-2}$ seconds) added between the time when 83% of silver nitrate was added and the time when 88% of silver nitrate was added was changed to $5\times10^{-7}$ in terms of Ir per mol of silver halide and furthermore, $K_2(IrCl_5$(thia)] (average electron releasing time: about $1\times10^{-1}$ second) was added in an amount of $2\times10^{-7}$ mol in terms of Ir per mol of silver halide.

(Preparation of Emulsion Be)

Emulsion B3 was prepared in the same manner as Emulsion Ba except that in place of $K_2[IrCl_5$(5-methylthia)] added between the time when 83% of silver nitrate was added and the time when 88% of silver nitrate, $K_2[IrCl_5$(thia)] (average electron releasing time: about $1\times10^{-1}$ second) and $K_2[IrCl_5$(S-methylthiourea)] (average electron releasing time: about $3\times10^{-2}$ seconds) were added in an amount of $1\times10^{-7}$ mol and $8\times10^{-7}$ mol, respectively, in terms of Ir per mol of silver halide and furthermore, between the time when 90% of silver nitrate was added and the time when 98% of silver nitrate was added, $K_2[IrCl_5(H_2O)]$ (average electron releasing time: about $7\times10^{-4}$ seconds) was added in an amount of $7\times10^{6}$ mol in terms of Ir per mol of silver halide.

A sample differing from Sample 204 of Example 2 only in that Emulsions B-1 and B-2 in the first layer (blue-sensitive emulsion layer) were replaced by Emulsion Bb (amount coated: 0.14 g/m$^2$ as silver) was prepared and designated as Sample 301. Similarly, a sample using Emulsion Bb instead was designated as Sample 302, a sample using Emulsion Bd instead was designated as Sample 303, a sample using Emulsion Bd instead was designated as Sample 304, and a sample using Emulsion Be instead was designated as Sample 305. The relationship between sample and blue-sensitive emulsion is shown in Table 4.

TABLE 4

| Sample | Blue-Sensitive Emulsion | Electron Releasing Dopant | Average Electron Releasing Time (sec) | Content, mol/mol-Ag | Remarks |
|---|---|---|---|---|---|
| 301 | Ba | $K_2[IrCl_5(5\text{-methyl-thiazole})]$ | $5 \times 10^{-2}$ | $8 \times 10^{-7}$ | Comparison |
| 302 | Bb | $K_2[IrCl_5(H_2O)]$ | $7 \times 10^{-4}$ | $1 \times 10^{-6}$ | Comparison |
| | | $K_2[IrCl_5(5\text{-methyl-thiazole})]$ | $5 \times 10^{-2}$ | $7 \times 10^{-7}$ | Comparison |
| 303 | Bc | $K_2[IrCl_5(H_2O)]$ | $7 \times 10^{-4}$ | $7 \times 10^{-6}$ | Invention |
| | | $K_2[IrCl_5(5\text{-methyl-thiazole})]$ | $5 \times 10^{-2}$ | $5 \times 10^{-7}$ | |
| 304 | Bd | $K_2[IrCl_5(5\text{-methyl-thiazole})]$ | $5 \times 10^{-2}$ | $5 \times 10^{-7}$ | Comparison |
| | | $K_2[IrCl_5(\text{thiazole})]$ | $1 \times 10^{-1}$ | $2 \times 10^{-7}$ | |
| 305 | Be | $K_2[IrCl_5(H_2O)]$ | $7 \times 10^{-4}$ | $7 \times 10^{-6}$ | Invention |
| | | $K_2[IrCl_5(\text{S-methyl-thiourea})]$ | $3 \times 10^{-2}$ | $8 \times 10^{-7}$ | |
| | | $K_2[IrCl_5(\text{thiazole})]$ | $1 \times 10^{-1}$ | $1 \times 10^{-7}$ | |

Each sample was subjected to 0.1-second, 0.0001-second or 0.000001-second gradation exposure for sensitometry by using a sensitometer. Six seconds after the exposure, exposed samples each was subjected to the same color development processing as in Example 1 and the yellow color density was measured. The sensitivity was read as a reciprocal of the exposure amount necessary for obtaining color formation with a reflection density of 0.7 at the 0.000001-second exposure and the sensitivity S of each sample was shown by a relative value to the sensitivity of Sample 301 (Emulsion Ba), which was taken as 100. A larger S value reveals higher sensitivity at short-time exposure and is more preferred. $DS_{0.1}$ shows a reflection density at an exposure amount, in terms of illuminance, 0.5 logE larger than the exposure amount necessary for obtaining a reflection density of 0.7 by 0.1-second exposure, $DS_{0.0001}$ shows a reflection density at an exposure amount, in terms of illuminance, 0.5 logE larger than the exposure amount necessary for obtaining a reflection density of 0.7 by 0.0001-second exposure, and $DS_{0.000001}$ shows a reflection density at an exposure amount, in terms of illuminance, 0.5 logE larger than the exposure amount necessary for obtaining a reflection density of 0.7 by 0.000001-second exposure. A smaller difference $D_{0.1}$-$DS_{0.0001}$ and a smaller difference $DS_{1.0}$-$DS_{0.000001}$ reveal less softening of contrast in the shoulder part at short-time exposure and are more preferred. In particular, a smaller $DS_{0.1}$–$DS_{0.000001}$ value reveals more excellent suitability for ultra-short time exposure. Furthermore, the change ΔD of density when the sample was processed 60 seconds after the same exposure with an exposure amount of giving a density of 1.7 at the time of performing the processing 6 seconds after 0.000001-second exposure was determined. In all samples, the density was increased in 60-second latent image from 6-second latent image. A smaller ΔD reveals higher stability of the latent image. These results are shown together in Table 5.

TABLE 5

| Sample | S | $DS_{0.1}$–$DS_{0.0001}$ | $DS_{0.1}$–$DS_{0.000001}$ | ΔD | Remarks |
|---|---|---|---|---|---|
| 301 | 100 | 0.31 | 0.41 | 0.12 | Comparison |
| 302 | 105 | 0.29 | 0.31 | 0.12 | Comparison |
| 303 | 124 | 0.05 | 0.10 | 0.04 | Invention |
| 304 | 115 | 0.07 | 0.13 | 0.14 | Comparison |
| 305 | 135 | 0.04 | 0.05 | 0.03 | Invention |

As seen from the results in Table 5, according to the present invention, an emulsion exhibiting high sensitivity and less softening of contrast in the shoulder part at high illuminance exposure and ensured with excellent latent image storability can be obtained. This effect is more excellent in Sample 305 using three electron releasing dopants.

The present application claims foreign priority based on Japanese Patent Application Nos. JP2003-068446 and JP2003-370062, filed Mar. 13, and Oct. 30 of 2003, respectively, the contents of which are incorporated herein by reference.

What is claimed is:

1. A silver halide emulsion comprising a silver halide grain containing at least two metal complexes each giving an average electron releasing time of $10^{-5}$ to 3 seconds, wherein among said at least two metal complexes, at least one metal complex gives an average electron releasing time of $10^{-5}$ to less than $10^{-2}$ second and at least one metal complex gives an average electron releasing time of $10^{-2}$ to 3 seconds, and all of said at least two metal complexes are metal complexes each having at least two different ligands;

wherein two of said at least two metal complexes are a first metal complex and a second metal complex having at least three times longer average electron releasing time than that of the first metal complex and the molar ratio of the amount of the first metal complex to that of the second metal complex is at least three times.

2. The silver halide emulsion as claimed in claim 1, wherein said at least two metal complexes each has at least one organic ligand.

3. The silver halide emulsion as claimed in claim 1, wherein among said at least two metal complexes, at least one metal complex is selected from the metal complexes represented by the following formula (I):

$$[IrX_{(6-n)}L_n]^m$$

wherein

X is a halogen ion or a pseudo-halogen ion,

L is a ligand different from X, n is an integer of 1 to 6, and m is an integer of −4 to +4.

4. The silver halide emulsion as claimed in claim 1, which has a silver chloride content from 95 to 99.8 mol %.

5. A silver halide color photographic light-sensitive material comprising a reflective support having thereon photographic constituent layers, the photographic constituent layers containing at least one yellow color-forming silver halide emulsion layer, at least one magenta color-forming silver halide emulsion layer and at least one cyan color-forming silver halide emulsion layer, wherein at least one of said silver halide emulsion layers contains the silver halide emulsion claimed in claim 1.

6. The silver halide color photographic light-sensitive material as claimed in claim 5, wherein when said silver halide color photographic light-sensitive material is exposed with light at a wavelength to which the silver halide emulsion layer containing the silver halide emulsion claimed in claim 1 is sensitive and then subjected to color development, the obtained reflection density satisfies the relationship in the following formula:

$$DS_{0.1}-DS_{0.0001}\leqq 0.3$$

wherein $DS_{0.1}$ represents a reflection density at an exposure amount, in terms of illuminance, 0.5 logE larger than the exposure amount necessary for obtaining a reflection density of 0.7 when exposed for 0.1 second with light at a wavelength to which said silver halide emulsion layer is sensitive and then subjected to color development, and $DS_{0.0001}$ represents a reflection density at an exposure amount, in terms of illuminance, 0.5 logE larger than the exposure amount necessary for obtaining a reflection density of 0.7 when exposed for 0.0001 second with light at a wavelength to which said silver halide emulsion layer is sensitive and then subjected to color development.

7. The silver halide color photographic light-sensitive material as claimed in claim 5, which is a silver halide color photographic light-sensitive material for rapid processing of starting the color development within 9 seconds from the imagewise exposure and thereby forming an image.

8. The silver halide color photographic light-sensitive material as claimed in claim 5, which is a silver halide color photographic light-sensitive material for rapid processing of completing the color development in 28 seconds or less and thereby forming an image.

9. The silver halide color photographic light-sensitive material as claimed in claim 5, wherein the total coated silver amount in the photographic constituent layers is from 0.25 to 0.46 g/m$^2$.

10. The silver halide emulsion as claimed in claim 1, wherein the first metal complex is represented by the following formula (Ia) and the second metal complex is represented by the following formula (Ic):

$$[IrX^a_{(6-n')}L^a_{n'}]^{m'} \qquad \text{Formula (Ia)}$$

wherein $X^a$ is a halogen ion or a pseudo-halogen ion, $L^a$ is a ligand different from $X^a$, n' is 1, 2 or 3, and m' is an integer of −4 to +1;

$$[IrX^c_{(6-n'')}L^c_{n''}]^{m''} \qquad \text{Formula (Ic):}$$

wherein $X^c$ is a halogen ion or a pseudo-halogen ion, $L^c$ is a 5- or 6-membered heterocyclic compound having at least two nitrogen atoms and at east one sulfur atom in the ring skeleton and having an arbitrary substituent on a carbon atom in the ring skeleton, n" is 1, 2 or 3, and m" is an integer of −4 to +1.

* * * * *